US011802727B2

(12) United States Patent
Knatt et al.

(10) Patent No.: US 11,802,727 B2
(45) Date of Patent: Oct. 31, 2023

(54) ICE MAKER

(71) Applicant: True Manufacturing Co., Inc., O'Fallon, MO (US)

(72) Inventors: Kevin Knatt, St. Louis, MO (US); Curt Cayemberg, Wentzville, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 485 days.

(21) Appl. No.: 16/746,828

(22) Filed: Jan. 18, 2020

(65) Prior Publication Data

US 2021/0222937 A1 Jul. 22, 2021

(51) Int. Cl.
*F25C 1/25* (2018.01)
*F25C 1/10* (2006.01)

(52) U.S. Cl.
CPC ..... *F25C 1/25* (2018.01); *F25C 1/10* (2013.01); *F25C 2400/10* (2013.01); *F25C 2400/14* (2013.01); *F25C 2700/04* (2013.01)

(58) Field of Classification Search
CPC ..... F25C 1/25; F25C 1/10; F25C 2400/10; F25C 2400/14; F25C 2700/04; F25C 2600/04; F25C 1/04; F25C 1/12; F25C 5/10; F25C 2500/06; F25C 2500/02; F04D 29/605; F04D 13/08; F04D 29/607; G01F 15/18
USPC ..... 62/259.2, 340
See application file for complete search history.

(56) References Cited

U.S. PATENT DOCUMENTS 2,723,536 A 11/1955 Mason
2,940,276 A * 6/1960 Loewenthal ..... F25C 1/12 62/347
3,025,679 A * 3/1962 Keighley ..... F25C 1/24 62/353
3,080,726 A 3/1963 Tenniswood
3,171,266 A 3/1965 Louis
3,254,501 A 6/1966 Brysselbout
3,407,621 A 10/1968 Ricks et al.
3,430,452 A 3/1969 Dedricks et al.
(Continued)

FOREIGN PATENT DOCUMENTS

DE 102013209875 A1 12/2014
GB 0618520 A * 5/1946
(Continued)

OTHER PUBLICATIONS

US 10,852,003 B2, 12/2020, Stroh (withdrawn)
(Continued)

*Primary Examiner* — Eric S Ruppert
*Assistant Examiner* — Kirstin U Oswald
(74) *Attorney, Agent, or Firm* — Stinson LLP

(57) ABSTRACT

An ice maker includes a water system that delivers water from a water reservoir to an ice formation device. A mount can hold one or both of a fitting of a water level sensor and a water pump in relation to the water reservoir. For example, the mount can include integral features that lock with the fitting to mount the fitting on the ice maker at a sensing position. The mount can include integral features that form a bayonet connection with a portion of the pump. A vertical support wall can included integrated features for supporting the mount in relation to the water reservoir.

33 Claims, 23 Drawing Sheets

(56) References Cited

U.S. PATENT DOCUMENTS 3,731,496 A 5/1973 Frazier
3,788,095 A 1/1974 Grace et al.
3,812,686 A 5/1974 Tester
3,876,327 A * 4/1975 Lobanoff ..... F04D 29/426 415/217.1
3,913,349 A 10/1975 Johnson
4,283,645 A * 8/1981 Hofmann ..... A01K 63/047 310/108
4,341,087 A 7/1982 Van Steenburgh, Jr.
4,455,843 A * 6/1984 Quarles ..... F25C 1/00 62/352
4,459,824 A 7/1984 Krueger
4,662,183 A * 5/1987 Keller ..... F25C 1/145 62/138
4,705,193 A * 11/1987 Aschberger ..... B01F 23/2362 62/392
4,899,548 A 2/1990 Dimijian
4,959,966 A * 10/1990 Dimijian ..... F25C 1/045 62/347
4,970,877 A 11/1990 Dimijian
5,184,942 A * 2/1993 Deininger ..... B01F 23/233 261/36.1
5,440,892 A 8/1995 Tatematsu et al.
5,477,694 A 12/1995 Black et al.
5,479,707 A 1/1996 Alvarez et al.
5,582,018 A * 12/1996 Black ..... F25C 1/12 62/347
5,752,393 A 5/1998 Schlosser et al.
5,904,054 A * 5/1999 Lee ..... F25C 1/25 62/347
5,922,030 A 7/1999 Shank et al.
6,000,228 A 12/1999 Johnson et al.
6,058,732 A 5/2000 Kato et al.
6,101,833 A 8/2000 Suzuki
6,105,385 A 8/2000 Kato et al.
6,109,055 A * 8/2000 Kato ..... F25C 1/12 62/347
6,196,007 B1 3/2001 Schlosser et al.
6,209,340 B1 4/2001 Lu
6,257,009 B1 7/2001 Tsuchikawa
6,324,855 B1 12/2001 Mullis
6,324,863 B1 12/2001 Henry
6,405,546 B1 6/2002 Billman et al.
6,418,736 B1 7/2002 Cover
6,453,696 B1 9/2002 Kawasumi et al.
6,463,746 B1 10/2002 Bethuy et al.
6,484,530 B1 11/2002 Hobino et al.
6,607,096 B2 8/2003 Glass et al.
6,612,126 B2 9/2003 Kawasumi et al.
6,619,051 B1 9/2003 Kilawee et al.
6,637,227 B2 10/2003 Stensrud et al.
6,668,575 B2 12/2003 Stensrud et al.
6,681,580 B2 1/2004 Shedivy et al.
6,705,107 B2 3/2004 Schlosser et al.
6,761,036 B2 7/2004 Teague et al.
6,821,362 B2 11/2004 Satou
6,854,277 B2 2/2005 Gist et al.
6,880,358 B2 4/2005 Lucas et al.
6,907,744 B2 6/2005 Miller et al.
7,010,932 B2 3/2006 Kuroyanagi et al.
7,017,355 B2 3/2006 Allison et al.
D526,338 S 8/2006 McDougal et al.
7,082,782 B2 8/2006 Schlosser et al.
7,168,262 B2 1/2007 Hirano et al.
D537,457 S 2/2007 McDougal et al.
D540,830 S 4/2007 Gunshi
7,197,889 B2 4/2007 Wakatsuki et al.
7,204,091 B2 4/2007 Allison et al.
7,269,960 B2 9/2007 Elsom et al.
7,273,990 B2 9/2007 Koshida et al.
7,281,386 B2 10/2007 McDougal et al.
7,284,391 B2 * 10/2007 Miller ..... F25B 5/02 62/347
7,287,671 B2 10/2007 Morrow, Sr. et al.
D557,716 S 12/2007 Okuda
7,343,749 B2 3/2008 Tsuchikawa et al.
7,444,828 B2 11/2008 Kadowaki et al.
7,444,829 B2 11/2008 Mori et al.
D597,107 S 7/2009 Ohtake
7,779,641 B2 8/2010 Lee et al.
7,802,444 B2 9/2010 Landers et al.
7,832,219 B2 11/2010 Baranowski et al.
7,975,497 B2 7/2011 Kaga et al.
7,980,090 B2 7/2011 Lanzani
8,042,344 B2 10/2011 Morimoto et al.
D649,565 S 11/2011 LaFond et al.
8,082,742 B2 12/2011 Broadbent et al.
8,087,533 B2 1/2012 Sellers
D653,682 S 2/2012 Herning et al.
8,136,365 B2 3/2012 Kaga et al.
8,230,696 B2 7/2012 Yamaguchi et al.
D668,272 S 10/2012 Ebelt et al.
D668,275 S 10/2012 LaFond et al.
D669,920 S 10/2012 LaFond et al.
D673,185 S 12/2012 LaFond et al.
8,336,741 B2 12/2012 Graviss et al.
8,341,968 B2 1/2013 Landers et al.
8,375,738 B2 2/2013 Kawasumi et al.
8,387,826 B2 3/2013 Tsubouchi et al.
8,484,935 B2 7/2013 LeBlanc et al.
8,505,595 B2 8/2013 Bragg et al.
8,528,357 B2 9/2013 Kondo et al.
D690,743 S 10/2013 Lafond et al.
D692,032 S 10/2013 LaFond et al.
8,567,013 B2 10/2013 Yamaoka et al.
8,677,774 B2 3/2014 Yamaguchi et al.
8,677,777 B2 3/2014 Yamaguchi et al.
D705,825 S 5/2014 Lafond et al.
8,738,302 B2 5/2014 Tirumala et al.
8,763,851 B2 7/2014 Jiang et al.
8,844,312 B2 9/2014 Yoshida et al.
9,038,410 B2 5/2015 Erbs et al.
9,052,130 B2 6/2015 Schlosser
9,061,881 B2 6/2015 Brown et al.
D734,371 S 7/2015 Lei et al.
D734,783 S 7/2015 Yong et al.
9,097,450 B2 8/2015 Kim et al.
9,126,815 B2 9/2015 Cooper et al.
9,146,049 B2 9/2015 Yamaguchi et al.
9,151,528 B2 10/2015 Erbs et al.
9,188,378 B2 11/2015 Maples
9,217,597 B2 12/2015 Mueller et al.
9,243,833 B2 1/2016 Yun et al.
9,273,894 B1 * 3/2016 Whitty ..... F25C 1/00
9,316,426 B2 4/2016 Almblad
9,346,659 B2 5/2016 Brown
9,351,571 B2 5/2016 Myers et al.
9,389,009 B2 7/2016 Olson, Jr. et al.
9,625,199 B2 4/2017 Antoine et al.
9,643,828 B2 5/2017 Brown et al.
9,644,879 B2 * 5/2017 Broadbent ..... F25C 5/185
9,803,907 B2 10/2017 Erbs et al.
9,933,195 B2 4/2018 Roth et al.
9,939,186 B2 4/2018 Roth et al.
10,001,306 B2 6/2018 Litchy et al.
10,059,580 B2 8/2018 Wyatt et al.
10,107,540 B2 10/2018 Olson, Jr. et al.
10,156,393 B2 12/2018 Tarr et al.
10,264,943 B2 4/2019 Toga et al.
10,266,383 B2 4/2019 Haskayne
10,274,239 B2 4/2019 Kobayashi et al.
10,300,161 B2 5/2019 Erbs
10,480,843 B2 11/2019 Short et al.
10,731,864 B2 8/2020 Wild
10,801,770 B2 10/2020 Broadbent
10,829,347 B2 11/2020 Rudy et al.
10,866,020 B2 12/2020 Hoti et al.
2002/0020177 A1 2/2002 Billman et al.
2002/0127007 A1 * 9/2002 Henrie ..... H05B 1/0244 392/501
2003/0010054 A1 1/2003 Esch et al.
2003/0046942 A1 3/2003 Shedivy et al.
2003/0089120 A1 5/2003 Kampert et al.

(56) References Cited

U.S. PATENT DOCUMENTS

| | | | | |
|---|---|---|---|---|
| 2003/0091440 | A1* | 5/2003 | Patel | F04D 29/426 417/40 |
| 2003/0145608 | A1 | 8/2003 | Billman et al. | |
| 2006/0026985 | A1* | 2/2006 | Hollen | F25D 21/14 62/340 |
| 2006/0272340 | A1 | 12/2006 | Petrenko | |
| 2006/0272830 | A1 | 12/2006 | Fima | |
| 2007/0089451 | A1 | 4/2007 | Lee | |
| 2007/0157636 | A1 | 7/2007 | Billman et al. | |
| 2008/0092567 | A1 | 4/2008 | Doberstein et al. | |
| 2008/0264082 | A1 | 10/2008 | Tikhonov et al. | |
| 2009/0009042 | A1 | 1/2009 | Kim et al. | |
| 2009/0179040 | A1 | 7/2009 | Hawkins | |
| 2010/0101244 | A1 | 4/2010 | Yoshida et al. | |
| 2010/0313524 | A1 | 12/2010 | Pape et al. | |
| 2010/0326093 | A1 | 12/2010 | Watson et al. | |
| 2012/0031126 | A1 | 2/2012 | Zhang et al. | |
| 2012/0090406 | A1* | 4/2012 | Etter | G01F 15/006 73/861.79 |
| 2014/0137593 | A1 | 5/2014 | Broadbent | |
| 2014/0137594 | A1 | 5/2014 | Broadbent | |
| 2014/0137984 | A1 | 5/2014 | Broadbent | |
| 2014/0144175 | A1 | 5/2014 | Broadbent | |
| 2014/0202180 | A1 | 7/2014 | Beuligman et al. | |
| 2014/0208781 | A1* | 7/2014 | Broadbent | F25C 5/185 62/66 |
| 2014/0208792 | A1 | 7/2014 | Broadbent | |
| 2014/0209125 | A1 | 7/2014 | Broadbent | |
| 2014/0216071 | A1 | 8/2014 | Broadbent | |
| 2014/0373735 | A1* | 12/2014 | Bruinsma | A47J 31/44 99/453 |
| 2015/0192338 | A1* | 7/2015 | Knatt | F25C 1/00 62/66 |
| 2015/0377538 | A1 | 12/2015 | Rockwell | |
| 2016/0007801 | A1 | 1/2016 | Bressner et al. | |
| 2016/0016133 | A1 | 1/2016 | Merritt et al. | |
| 2016/0045063 | A1 | 2/2016 | Mantle et al. | |
| 2016/0054043 | A1* | 2/2016 | Broadbent | F25C 5/142 62/135 |
| 2016/0054044 | A1 | 2/2016 | Jeong et al. | |
| 2016/0095450 | A1 | 4/2016 | Trulaske, Sr. | |
| 2016/0159520 | A1 | 6/2016 | Vemula et al. | |
| 2016/0290697 | A1 | 10/2016 | Broadbent et al. | |
| 2016/0298893 | A1* | 10/2016 | Knatt | F25C 5/10 |
| 2016/0327352 | A1 | 11/2016 | Broadbent et al. | |
| 2016/0334157 | A1 | 11/2016 | Broadbent et al. | |
| 2016/0370061 | A1 | 12/2016 | Erbs | |
| 2017/0003062 | A1 | 1/2017 | Olson, Jr. et al. | |
| 2017/0023284 | A1 | 1/2017 | Broadbent | |
| 2017/0067678 | A1 | 3/2017 | Melton et al. | |
| 2017/0176077 | A1 | 6/2017 | Knatt | |
| 2017/0183210 | A1 | 6/2017 | Wyatt et al. | |
| 2017/0370628 | A1 | 12/2017 | Knatt | |
| 2018/0017304 | A1 | 1/2018 | Knatt | |
| 2018/0023847 | A1 | 1/2018 | Kobayashi et al. | |
| 2018/0023874 | A1 | 1/2018 | Kobayashi et al. | |
| 2018/0031294 | A1 | 2/2018 | Olson, Jr. et al. | |
| 2018/0106521 | A1 | 4/2018 | Broadbent et al. | |
| 2018/0142932 | A1 | 5/2018 | Knatt et al. | |
| 2018/0283760 | A1 | 10/2018 | Knatt et al. | |
| 2018/0313593 | A1 | 11/2018 | Olvera et al. | |
| 2019/0008004 | A1 | 1/2019 | Wild | |
| 2020/0121080 | A1* | 4/2020 | Wantland | A47B 96/025 |
| 2020/0400358 | A1 | 12/2020 | Romagnoli | |

FOREIGN PATENT DOCUMENTS

| | | | | | |
|---|---|---|---|---|---|
| GB | 1244831 | | | 9/1971 | |
| GB | 2282216 | A | * | 3/1995 | F25C 1/04 |
| JP | S5785170 | U | | 5/1982 | |
| JP | S59107172 | U | | 6/1984 | |
| JP | H08285419 | A | | 11/1996 | |
| JP | 2003021441 | A | | 1/2003 | |
| JP | 2003130507 | A | | 5/2003 | |
| JP | 2005016798 | A | | 1/2005 | |
| JP | 2006010181 | A | | 1/2006 | |
| KR | 20040085284 | A | | 10/2004 | |
| KR | 20090004163 | A | | 1/2009 | |
| KR | 20120045362 | | | 5/2012 | |
| WO | 20040083971 | A1 | | 9/2004 | |
| WO | WO-2006032231 | A | * | 3/2006 | |
| WO | 20150065564 | A1 | | 5/2015 | |
| WO | 20150171121 | A1 | | 11/2015 | |
| WO | 20160007738 | A1 | | 1/2016 | |
| WO | 20160011103 | A1 | | 1/2016 | |
| WO | 20160025845 | A1 | | 2/2016 | |
| WO | 20160057064 | A1 | | 4/2016 | |
| WO | 201600654866 | A1 | | 4/2016 | |
| WO | 20160089410 | A1 | | 6/2016 | |
| WO | 201600146082 | A1 | | 9/2016 | |
| WO | 20160181702 | A1 | | 11/2016 | |
| WO | 20160205685 | A1 | | 12/2016 | |
| WO | 20170004212 | A1 | | 1/2017 | |
| WO | 20170077295 | A1 | | 5/2017 | |
| WO | 20170083359 | A1 | | 5/2017 | |
| WO | 2017095691 | A1 | | 6/2017 | |
| WO | 2017102494 | A1 | | 6/2017 | |
| WO | 2017162680 | A1 | | 9/2017 | |
| WO | 2017180578 | A1 | | 10/2017 | |
| WO | 2017182214 | A1 | | 10/2017 | |
| WO | 2018007318 | A1 | | 1/2018 | |
| WO | 20180011711 | A1 | | 1/2018 | |
| WO | 20180022097 | A1 | | 2/2018 | |
| WO | 20180147843 | A1 | | 8/2018 | |
| WO | 20180148096 | A1 | | 8/2018 | |
| WO | 2018158186 | A1 | | 9/2018 | |
| WO | 2019143354 | A1 | | 7/2019 | |
| WO | 2019164480 | A1 | | 8/2019 | |

OTHER PUBLICATIONS

Extended European Search Report, received from counterpart European Application No. 21151914.5-1009, 11 pages.

Extended European Search Report, received from European Application No. 14746041-105, dated Aug. 5, 2016, 8 pages.

Extended European Search Report, received from European Application No. 15834551.1009, dated Feb. 23, 2018, 7 pages.

International Search Report, received from PCT/US0215/045809, dated Nov. 26, 2016, 3 pages.

* cited by examiner

ICE MAKER

FIELD

The present disclosure pertains to an ice maker including a mount for at least one of a water level sensor and a water pump.

BACKGROUND

Ice makers that produce cube-, flake- or nugget-type (i.e., compressed flake) ice are well known and in extensive use. Such machines have received wide acceptance and are particularly desirable for commercial installations such as restaurants, bars, hotels, healthcare facilities and various beverage retailers having a high and continuous demand for fresh ice. Ice makers typically include a refrigeration system that cools an ice formation device and a water system that directs water to the ice formation device, where the water is formed into ice. Water systems use various components to control how water is directed to an ice formation device. A water pump is commonly employed to pump water from a reservoir through passaging that communicates with the ice formation system. Water level sensors that detect the amount of water in the reservoir can be used as a control input for controlling the pump and/or other aspects of the ice maker.

SUMMARY

In one aspect, an ice maker for forming ice comprises a refrigeration system comprising an ice formation device and a water system for supplying water to the ice formation device. The water system comprises a water reservoir configured to hold water to be formed into ice. Passaging provides fluid communication between the water reservoir and the ice formation device. A water level sensor for detecting an amount of water in the reservoir includes a fitting and a sensor mount for mounting the fitting of the water level sensor on the ice maker at a sensing position in which the fitting connects the water level sensor to the reservoir for detecting the amount of water in the reservoir. The sensor mount is configured to be lockingly engaged with the fitting to releasably mount the fitting on the ice maker at the sensing position.

In another aspect, an ice maker for forming ice comprises a refrigeration system comprising an ice formation device and a water system for supplying water to the ice formation device. The water system comprises a water reservoir configured to hold water to be formed into ice. Passaging provides fluid communication between the water reservoir and the ice formation device. A water pump is configured to pump water from the water reservoir through the passaging to the ice formation device. A pump mount mounts the water pump on the ice maker for pumping water from the water reservoir through the passaging. The water pump is configured to be connected to the pump mount by a bayonet connection.

In another aspect, an ice maker for forming ice comprises a refrigeration system comprising an ice formation device and a water system for supplying water to the ice formation device. The water system comprises a water reservoir configured to hold water to be formed into ice. Passaging provides fluid communication between the water reservoir and the ice formation device. A water pump is configured to pump water from the water reservoir through the passaging to the ice formation device. A water level sensor detects an amount of water in the reservoir. The water reservoir comprises a bottom portion and a top portion extending across at least part of the bottom portion. The top portion of the water reservoir defines a sensor mount for mounting at least a portion of the water level sensor on the water reservoir for detecting the amount of water in the reservoir and a pump mount for mounting at least a portion of the water pump on the water reservoir for pumping water from the water reservoir through the passaging.

In yet another embodiment, an ice maker for forming ice comprises a refrigeration system comprising an ice formation device. A water system for supplying water to the ice formation device comprises a water reservoir configured to hold water to be formed into ice. Passaging provides fluid communication between the water reservoir and the ice formation device. A water pump is configured to pump water from the water reservoir through the passaging to the ice formation device. A water level sensor detects an amount of water in the reservoir. A mounting plate is connected to at least one of the water level sensor and the water pump. A support comprises at least one vertically extending support wall formed from a single monolithic piece of material. The vertically extending support wall includes first and second integrally formed connectors. The first connector is configured to attach the mounting plate to the support and the second connector is configured to attach the pump to the support such that the support positions the mounting plate with respect to the pump so that at least one of (a) the water level sensor connected to the mounting plate is configured to detect the amount of water in the reservoir and (b) the water pump connected to the mounting plate is configured to pump water from the water reservoir through the passaging.

Other aspects will be in part apparent and in part pointed out hereinafter.

BRIEF DESCRIPTION OF THE DRAWINGS

Corresponding reference characters indicate corresponding parts throughout the drawings.

DETAILED DESCRIPTION

In general, this disclosure pertains to an ice maker that includes a mount for mounting at least a portion of one or both of a water level sensor and a water pump on an ice maker. The inventors have recognized that, when water level sensors and water pumps are installed in an ice maker using conventional techniques, the devices can be difficult to access and remove when it comes time for maintenance or repair. In certain embodiments, a mount in accordance with one or more aspects of the present disclosure can mount a water level sensor and/or a water pump so that the device can be readily removed for maintenance or repair. As will be explained in further detail below, in certain embodiments, mounts are provided that allow water system devices such as components of water level sensors and/or water pumps to be operatively installed in an ice maker without using separate fasteners or using only fasteners that attach at locations that are near a point of access.

Figure 1:
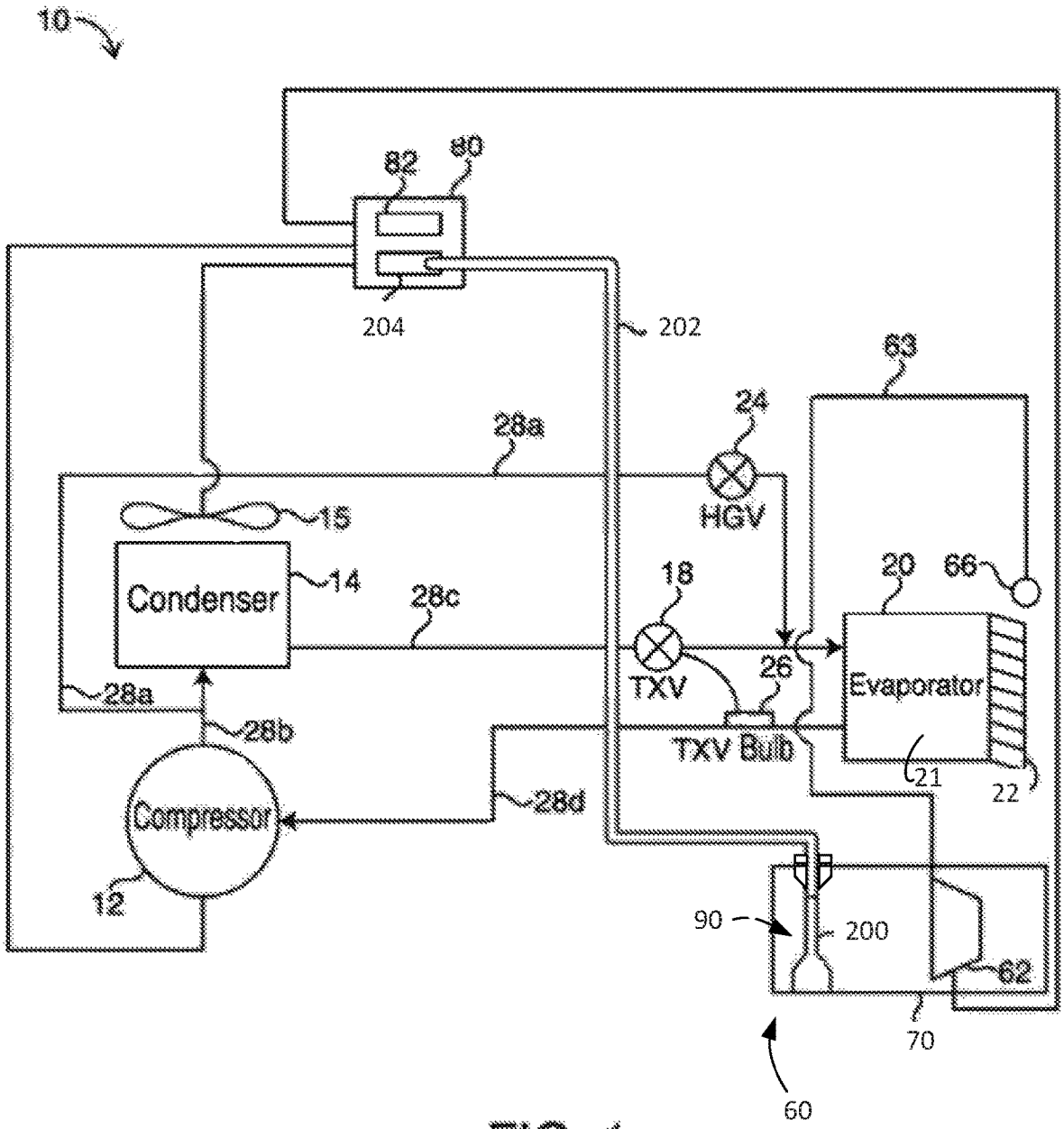
FIG. 1 is a schematic block diagram of an ice maker.

FIG. 1 illustrates certain principal components of one embodiment of an ice maker 10 having a refrigeration system and water system. The refrigeration system of the ice maker 10 includes a compressor 12, a heat rejecting heat exchanger 16, a refrigerant expansion device 18 for lowering the temperature and pressure of the refrigerant, an ice formation device 20, and hot gas valve 24. As shown, it will be understood that the heat rejecting heat exchanger 16 may comprise a condenser for condensing compressed refrigerant vapor discharged from the compressor 12. However, in other embodiments, for example, in refrigeration systems that utilize carbon dioxide refrigerants where the heat of rejection is trans-critical, heat rejecting heat exchanger is able to reject heat from the refrigerant without condensing the refrigerant. The ice formation device 20 includes an evaporator 21 and a freeze plate 22 thermally coupled to the evaporator 21. The evaporator 21 is constructed of serpentine tubing (not shown) as is known in the art. In certain embodiments, the freeze plate 22 contains a large number of pockets (usually in the form of a grid of cells) on its surface where water flowing over the surface can collect. Hot gas valve 24 is used, in one or more embodiments, to direct warm refrigerant from the compressor 15 directly to the evaporator 21 to remove or harvest ice cubes from the freeze plate 22 when the ice has reached the desired thickness.

The refrigerant expansion device 18 can be of any suitable type, including a capillary tube, a thermostatic expansion valve or an electronic expansion valve. In certain embodiments, where the refrigerant expansion device 18 is a thermostatic expansion valve or an electronic expansion valve, the ice maker 10 may also include a temperature sensor 26 placed at the outlet of the evaporator 21 to control the refrigerant expansion device 18. In other embodiments, where the refrigerant expansion device 18 is an electronic expansion valve, the ice maker 10 may also include a pressure sensor (not shown) placed at the outlet of the evaporator 21 to control the refrigerant expansion device 19 as is known in the art. In certain embodiments that utilize a gaseous cooling medium (e.g., air) to provide condenser cooling, a condenser fan 15 may be positioned to blow the gaseous cooling medium across the condenser 14. A form of refrigerant cycles through these components via refrigerant lines 28*a*, 28*b*, 28*c*, 28*d*.

The water system of the illustrated ice maker 10 includes a sump assembly 60 that comprises a water reservoir or sump 70, a water pump 62, and a water level sensor 90, The water system of the ice maker 10 further includes a water supply line (not shown) and a water inlet valve (not shown) for filling sump 70 with water from a water source (not shown). In one or more embodiments, the water system of the ice maker 10 further includes a discharge line (not shown) and a discharge valve (not shown; e.g., purge valve, drain valve) disposed thereon for draining water from the tank. The water system 14 further comprises a water line 63 and a water distributor 66 (e.g., manifold, pan, tube, etc.) that generally constitute passaging for fluidly connecting the sump 70 to the freeze plate 22. During operation of the ice maker 10, the pump 62 pumps water from the sump 70 through the water line 63 and out of the water distributor 66 onto the freeze plate 22. The distributor 66 distributes water onto the freeze plate 22 so that the water flows over the pockets of freeze plate and freezes into ice. The sump 70 may be positioned below the freeze plate 22 to catch the water coming off of the freeze plate such that the water may be recirculated by water pump 62. In one or more embodiments, the water distributor 66 comprises any of the water distributors described in U.S. Patent Application Publication No. 2014/0208792, which is incorporated herein by reference in its entirety.

The ice maker 10 may also include a controller 80. The controller 80 may be located remote from the ice making device 20 and the sump 70 or may comprise one or more onboard processors, in one or more embodiments. The controller 80 may include a processor 82 for controlling the operation of the ice maker 10 including the various components of the refrigeration system and the water system. The processor 82 of the controller 80 may include a non-transitory processor-readable medium storing code representing instructions to cause the processor to perform a process. The processor 82 may be, for example, a commercially available microprocessor, an application-specific integrated circuit (ASIC) or a combination of ASICs, which are designed to achieve one or more specific functions, or enable one or more specific devices or applications. In certain embodiments, the controller 80 may be an analog or digital circuit, or a combination of multiple circuits. The controller 80 may also include one or more memory components (not shown) for storing data in a form retrievable by the controller. The controller 80 can store data in or retrieve data from the one or more memory components.

In various embodiments, the controller 80 may also comprise input/output (I/O) components (not shown) to communicate with and/or control the various components of ice maker 10. In certain embodiments, for example the controller 80 may receive inputs such as, for example, one or more indications, signals, messages, commands, data, and/or any other information, from a water reservoir water level sensor 90, a harvest sensor for determining when ice has been harvested (not shown), an electrical power source (not shown), an ice level sensor (not shown), and/or a variety of sensors and/or switches including, but not limited to, pressure transducers, temperature sensors, acoustic sensors, etc. In various embodiments, based on those inputs for example, the controller 80 may be able to control the compressor 12, the condenser fan 15, the refrigerant expansion device 18, the hot gas valve 24, the water inlet valve, the discharge valve, and/or the water pump 62, for example, by sending, one or more indications, signals, messages, commands, data, and/or any other information to such components.

Figure 2:
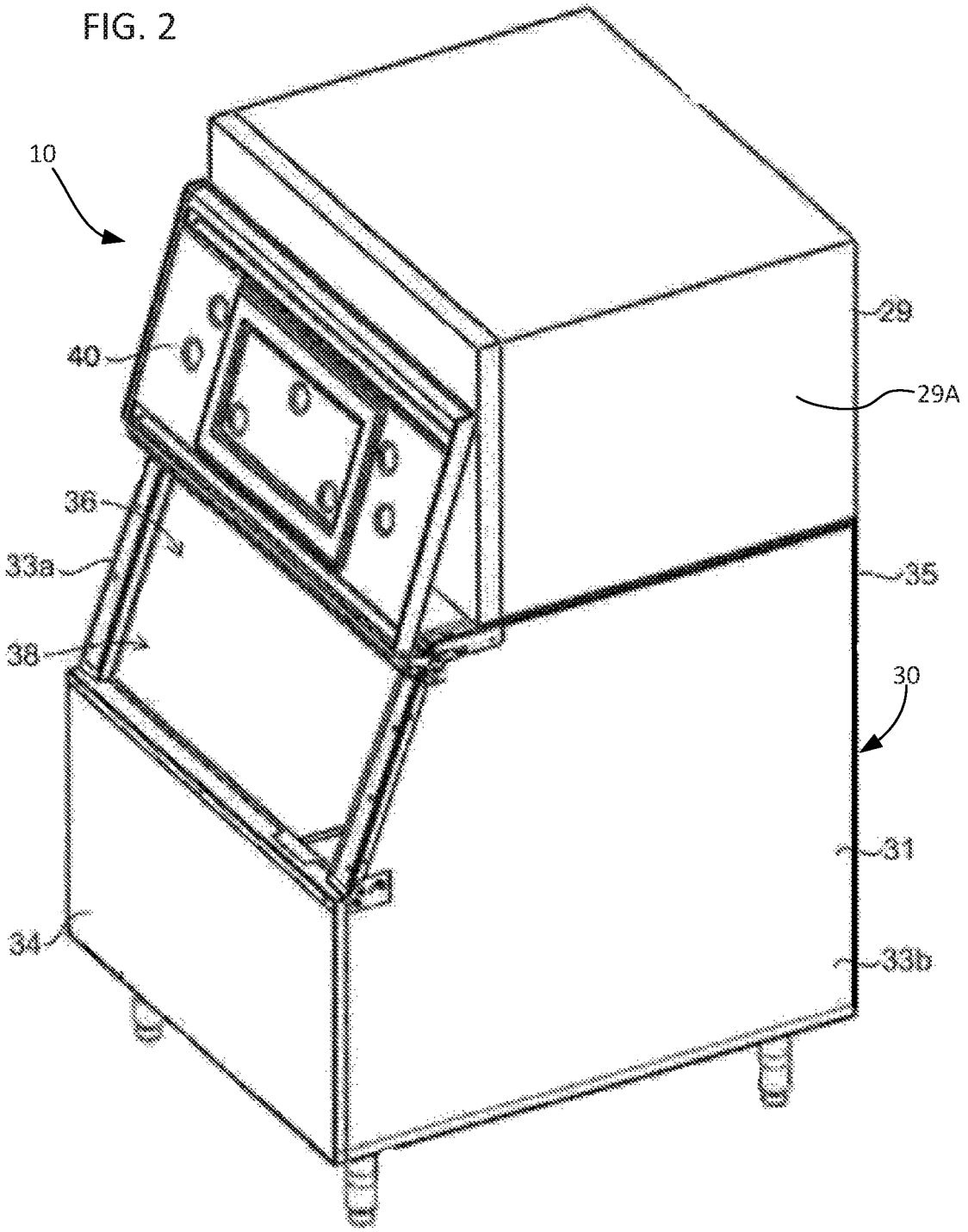
FIG. 2 is a perspective of the ice maker supported on a bin.

Referring to FIG. 2, one or more components of the ice maker 10 may be stored inside of a cabinet 29 (broadly, a housing). In the illustrated embodiment, the cabinet 29 is mounted on top of an ice storage bin assembly 30. The cabinet 29 may be closed by suitable fixed and removable panels to provide temperature integrity and compartmental access, as will be understood by those skilled in the art. The illustrated cabinet includes a pump access panel 29A that is removable to reveal a pump access opening (not shown) through which the water pump 62 can be removed from the sump assembly 60 and the cabinet 29.

The ice storage bin assembly 30 includes an ice storage bin 31 having an ice hole (not shown) through which ice produced by the ice maker 10 falls. The ice is then stored in a cavity 36 until retrieved. The ice storage bin 31 further includes an opening 38 which provides access to the cavity 36 and the ice stored therein. The cavity 36, ice hole (not shown), and opening 38 are formed by a left wall 33 *a*, a right wall 33 *b*, a front wall 34, a back wall 35 and a bottom wall (not shown). The walls of the ice storage bin 31 may be thermally insulated with various insulating materials including, but not limited to, fiberglass insulation or open- or closed-cell foam comprised, for example, of polystyrene or polyurethane, etc. in order to retard the melting of the ice stored in the ice storage bin 31. A door 40 can be opened to provide access to the cavity 36.

Figure 3:
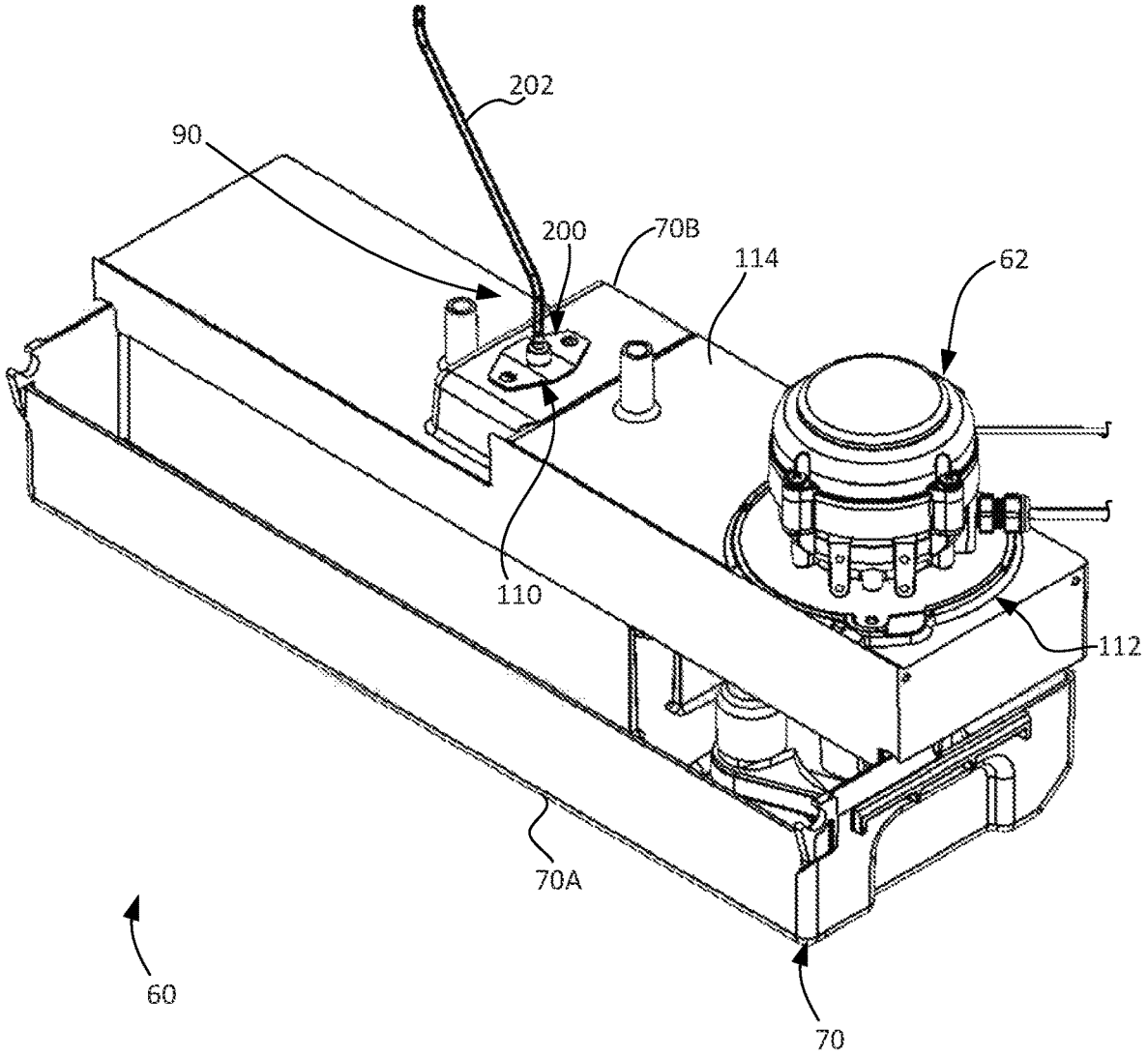
FIG. 3 is a perspective of a sump assembly of the ice maker.
Figure 4:
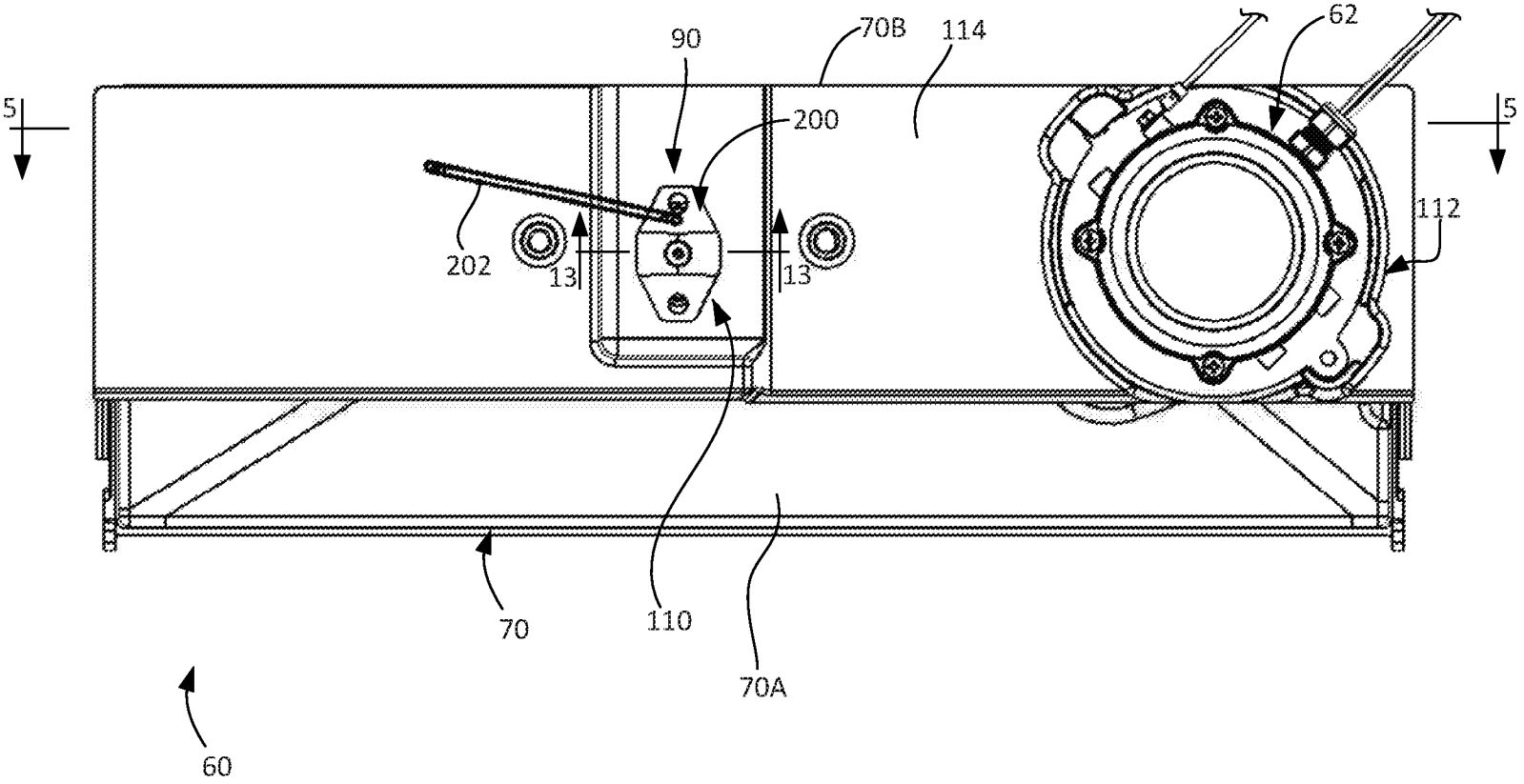
FIG. 4 is a top plan view of the sump assembly.
Figure 5:
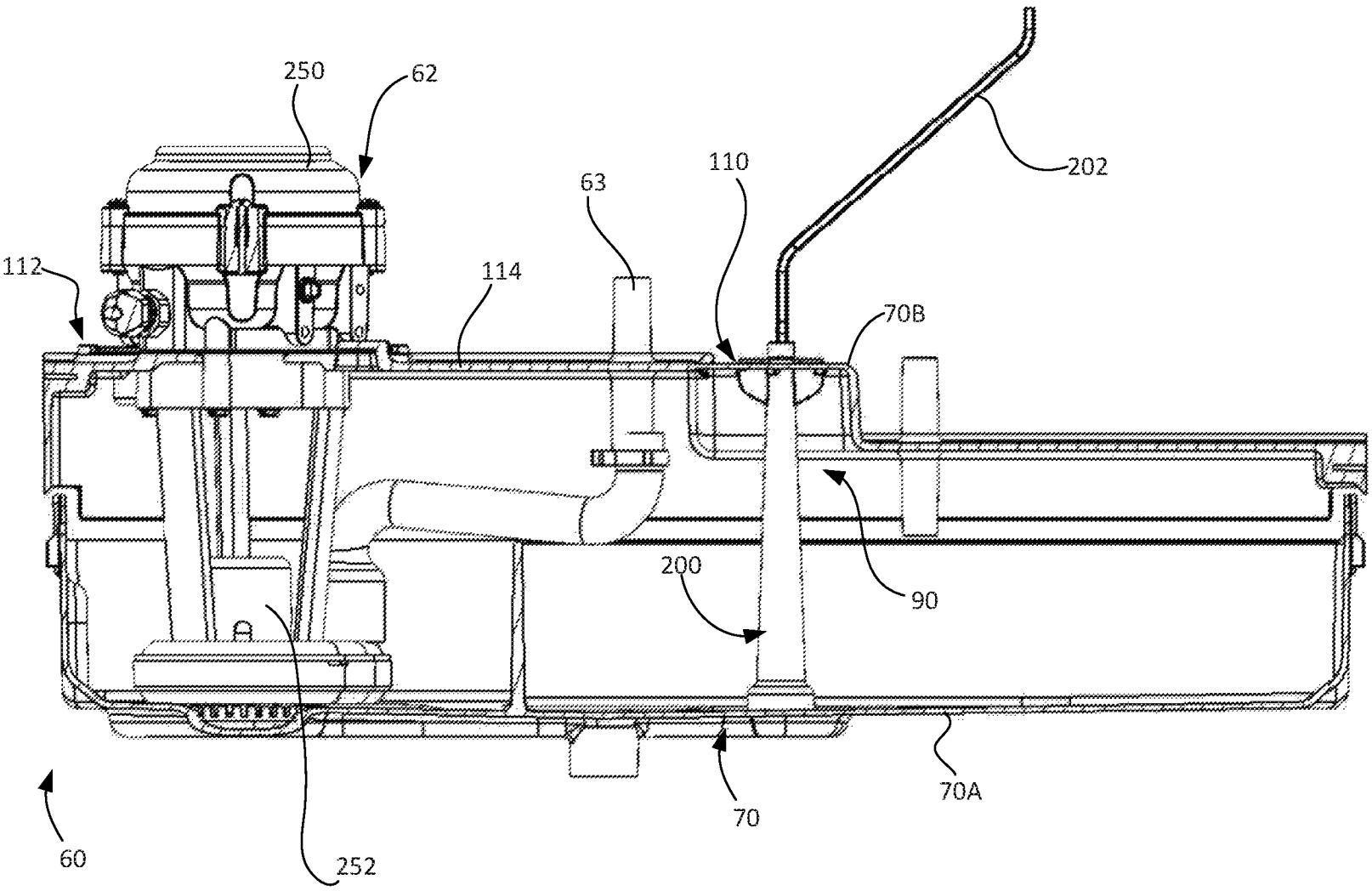
FIG. 5 is a cross section taken in the plane of line 5-5 of FIG. 4.

Referring to FIGS. 3-5, the sump assembly 60 includes mounting features for mounting at least portions of the water level sensor 90 and the water pump 62 on the sump 60. The sump 70 comprises a bottom portion 70A that is configured to hold water. The illustrated sump 70 further comprises a top portion 70B that extends across at least part of the bottom portion 70A at a location vertically spaced above a bottom wall of the sump. In one or more embodiments, the bottom portion 70A and the top portion 70B of the sump are discrete parts. The bottom portion 70A of the sump 70 defines a sump tank that is configured to hold water. Together the top portion 70B and the bottom portion 70A define a sump enclosure having a partially open top to allow water to flow off of the freeze plate 22 into the sump tank 70A. As will be explained in further detail below, the top portion 70B of the sump 70 defines a sensor mount 110 for mounting a fitting 200 of the water level sensor 90 on the sump at a sensing position at which the water level sensor is operative to detect the amount of water in the reservoir. The top portion 70B of the sump also defines a pump mount 112 for mounting the water pump 62 on the sump 70 for pumping water from the sump through the water line 63 and the distributor 66. As will be explained in further detail below, each of the sensor mount 110 and the pump mount 112 includes locking features that facilitate releasably connecting the respective one of the water level sensor 90 and the water pump 62 to the sump 70.

In the illustrated embodiment, the top portion 70B of the sump 70 includes a unitary mounting plate 114 that is formed from a single, monolithic piece of material. The unitary mounting plate 114 is configured for mounting both the water level sensor 90 and the water pump 62 on the ice maker 10, in one or more embodiments. In certain embodiments, one or more locking features for releasably connecting one or both of the water level sensor 90 and the water pump 62 to the sump 70 are integrally formed with the unitary mounting plate 114. In some embodiments, locking features can also be separately attached to the mounting plate and/or the mounting plate can be formed from more than one piece.

Figure 6:
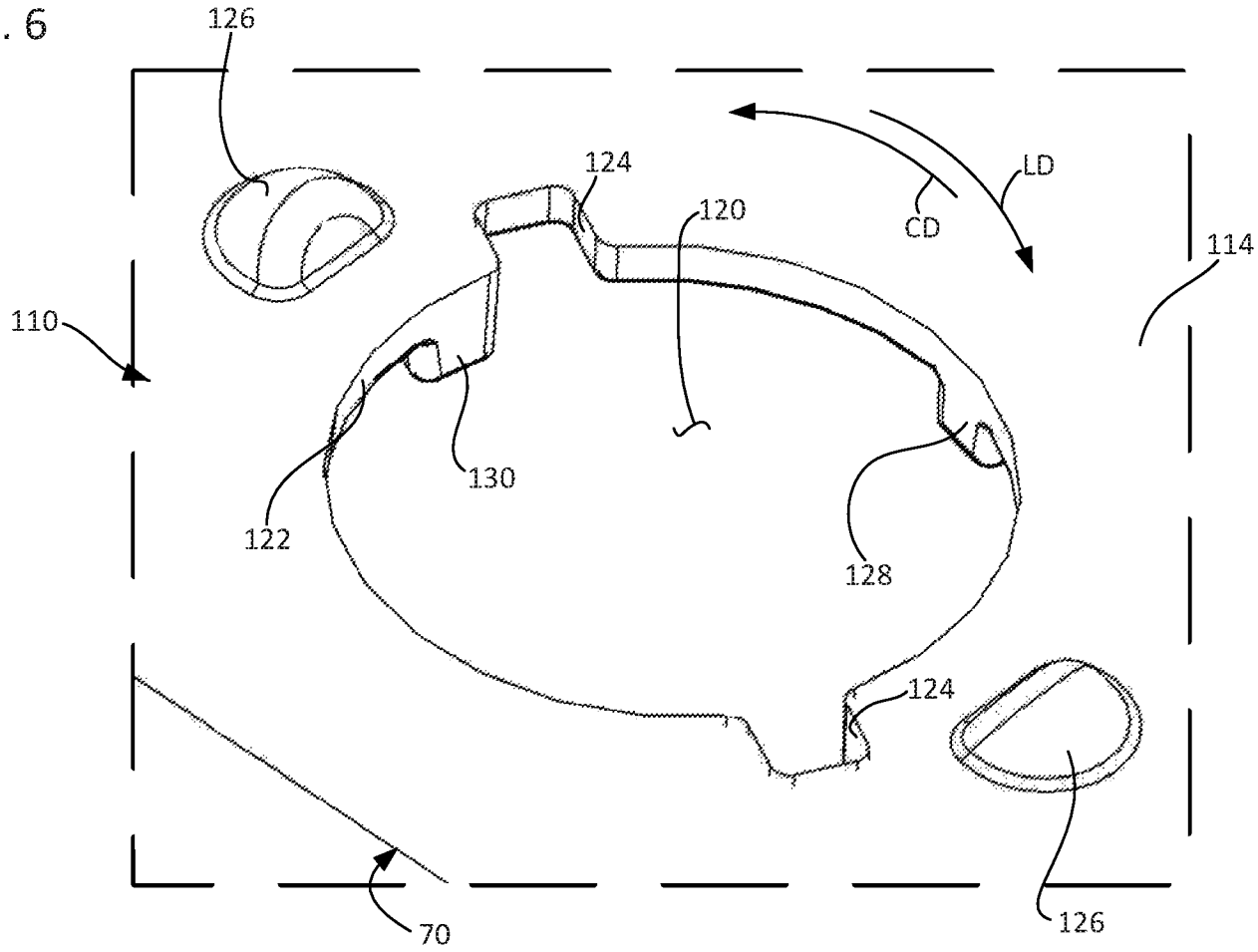
FIG. 6 is an enlarged perspective of a portion of the sump assembly including a sensor mount with a fitting of a water level sensor removed from the sump assembly.

Referring to FIG. 6, in one or more embodiments, the sensor mount 110 comprises a sensor opening 120 formed in the mounting plate 114. As will be explained in further detail below, the fitting 200 of the water level sensor 90 (broadly, a portion of the water level sensor) is passable through the sensor opening 120. Moreover, the sensor mount 110 is lockingly engageable with the fitting 200 to releasably connect the water level sensor 90 to the sump 70. Suitably, the locking engagement between the sensor mount 110 and the fitting 200 connects the sensor 90 to the sump 70 at a sensing position at which the water level sensor is configured to detect the amount of water in the sump.

In the illustrated embodiment, the sensor opening 120 forms part of a bayonet connection. The illustrated sensor opening 120 includes a generally circular central portion 122 and two elongate bayonet slots 124 extending outwardly from a perimeter of the central portion on opposite sides of (broadly, spaced apart locations about) the central portion. The illustrated bayonet slots 124 are configured so that a pair of diametrically opposed bayonet elements of the sensor fitting 200 are passable through the slots, as will be described in further detail below. As will also be explained in further detail below, after the fitting 200 is inserted into the sensor opening 120, it is rotatable with respect to the mounting plate 114 to lockingly engage the mount 110 and mount the sensor 90 on the sump 70 by the bayonet connection. Other sensor openings can have other shapes and arrangements, in other embodiments. For example, in one or more embodiments, it is contemplated that a sensor opening has other numbers and arrangements of bayonet slots.

In the illustrated embodiment, the sensor mount 110 further comprises a pair of detents 126 configured for inhibiting rotation of the sensor fitting 200 when it is connected to the sensor mount. In the illustrated embodiment, the detents 126 comprise protrusions on the top surface of the mounting plate 114. In certain embodiments, the detents can comprise another structural element, such as a protrusion along a bottom surface or edge of the sensor opening or a recess formed in the mounting plate. In the illustrated embodiment, the detents 126 are located on diametrically opposite sides of (broadly, spaced apart locations about) the central portion 122 of the sensor opening 120. In addition, the illustrated detents 126 are spaced apart from the bayonet slots 124 about the central portion 122. As will be explained in further detail below, a portion of the sensor fitting 200 is configured to engage the detents 126 when the fitting passes into the sensor opening 120 and rotates in a locking rotational direction LD toward a locked position.

Referring still to FIG. 6, the illustrated sensor mount 110 further comprises at least one rotation stop, for example, a pair of rotation stops 128, 130 that are spaced apart about the perimeter of the central portion 122 of the opening 120 on opposite sides of a respective one of the bayonet slots 124. In one or more embodiments, the sensor mount 110 includes a respective pair of stops 128, 130 on opposite sides of each bayonet slot 124. (Only one pair of stops is shown in FIG. 6 due to the orientation of the drawing.) For each bayonet slot 124, the stop 128 is an over-rotation stop, and the stop 130 is a counter-rotation stop. The over-rotation stop 128 comprises a protrusion formed on the bottom surface of the mounting plate 114 adjacent the perimeter of the central portion 122 at a location spaced from the respective bayonet slot 124 in a locking rotational direction LD. The counter-rotation stop 130 likewise comprises a protrusion formed on the bottom surface of the mounting plate adjacent the perimeter of the central portion 122. The counter-rotation stop 130 is located immediately adjacent the respective bayonet slot 124 in a counter-rotation direction CD opposite the locking rotational direction LD. As will be explained in further detail below, the counter-rotation stop 130 is configured to inhibit rotation of the fitting 200 in the counter-rotational direction CD after it is inserted into the sensor opening 120, and the over-rotation stop 128 is configured to inhibit rotation of the sensor fitting in the locking rotational direction LD beyond a locked position.

Figure 7:
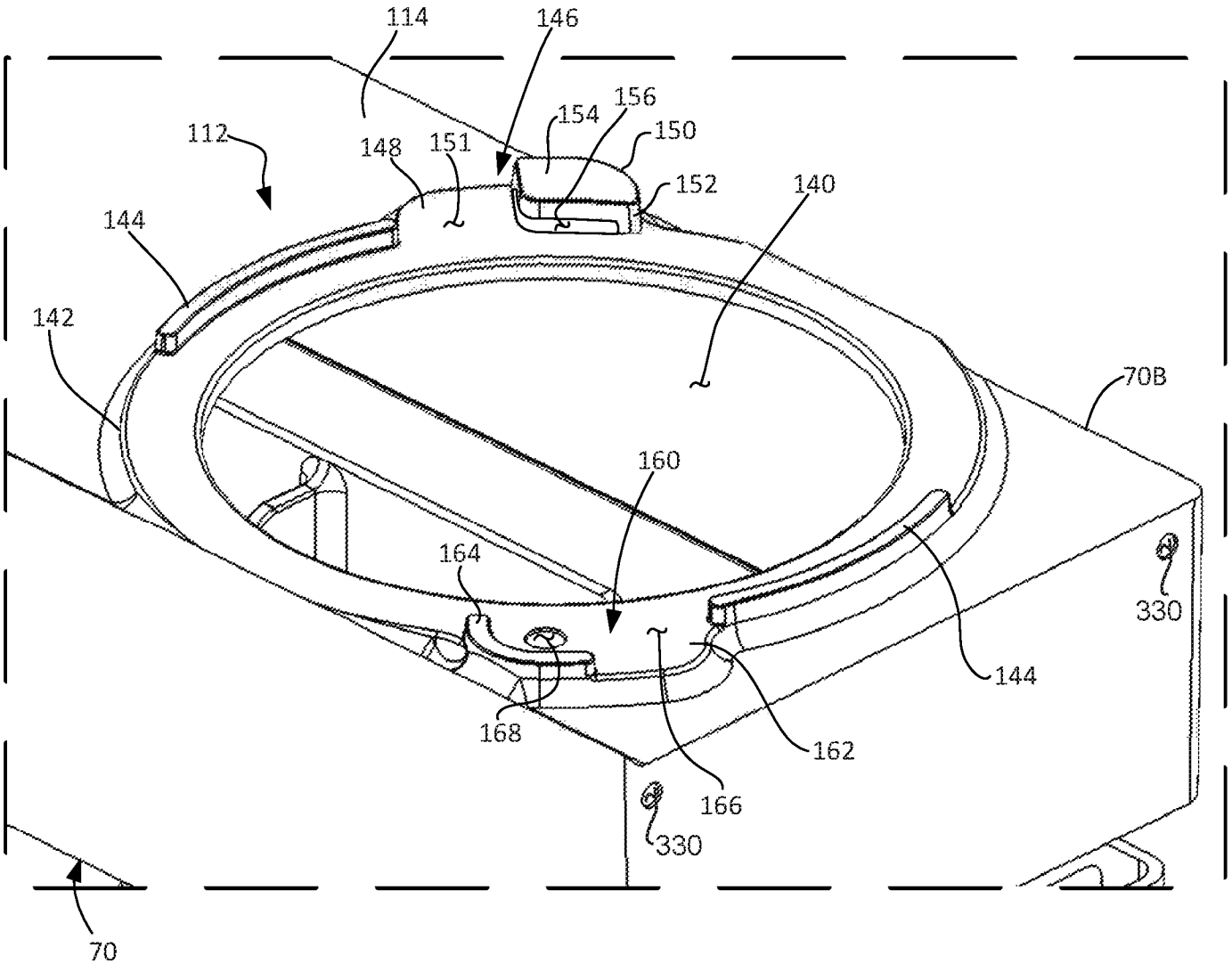
FIG. 7 is an enlarged perspective of a portion of the sump assembly including a pump mount when a water pump is removed from the sump assembly.

Referring of FIG. 7, in one or more embodiments, the pump mount 112 comprises a pump opening 140 formed in the mounting plate 114. As will be explained in further detail below, a portion of the water pump 62 is passable through the pump opening 140, and the pump mount 114 is lockingly engageable with the pump to releasably connect at least one side of the pump to the sump 70. Suitably, the locking engagement between the pump mount 112 and the water pump 62 connects the pump to the sump 70 at an operative position in which the pump is configured to pump water in the sump tank 70A of the sump through the water line 63 (see FIG. 5).

In the illustrated embodiment, the pump opening 140 comprises a generally circular hole through the mounting plate 114. The illustrated pump mount 112 comprises a raised mounting collar 142 extending about the pump opening 140. A pair of arcuate centering rails 144 are formed along the collar perimeter on opposite sides of (broadly, spaced apart locations about) the collar 142. The rails 144 are configured to bear against a portion of the water pump 62 supported on the mounting collar and thereby constrain the water pump to rotate generally about the center of the pump opening 140.

The illustrated pump mount 112 further comprises a bayonet connection region 146 along a portion of the mounting collar 142 that is located toward the side of the pump mount that is relatively inboard of the cabinet 29 when the sump assembly 60 is in use. In other words, the bayonet connection region 146 is located on a side of the pump mount 112 that is relatively remote from the pump access opening revealed by removal of the access panel 29A (FIG. 2). The pump itself is located between the pump access opening and the bayonet connection region 146 during use. As will be explained in further detail below, the bayonet connection region 146 is configured to releasably connect a remote side of the pump 62 to the sump 70 without using any separate fasteners or tools.

The bayonet connection region 146 comprises a pad 148 projecting radially from the mounting collar 142 and a receiver 150 extending upward at one end portion of the pad. In one or more embodiments, the bayonet connection region 146 is configured so that a gap 151 is defined along the pad 148 between the adjacent rail 144 and the receiver 150. The illustrated receiver 150 includes a wall portion 152 extending upward from the pad 149 and a top portion 154 supported on the wall portion in vertically spaced apart relation with the pad. A bayonet slot 156 is defined between the top portion 154 of the receiver 150 and a portion of the mounting plate 114, e.g., the pad 148. A bayonet receiver that defines a bayonet slot can also have other configurations in one or more embodiments. As will be explained in further detail below, a bayonet element of the water pump 62 is configured to be positioned on the pad 148 in the gap 151 and then rotated into the bayonet slot 156 to releasably connect one side of the pump to the sump 70 by a bayonet connection.

The illustrated pump mount 112 further comprises a screw connection region 160 along a portion of the mounting collar that is located adjacent the access panel 29A (FIG. 2) and pump access opening when the sump assembly 60 is in use. For example, the screw connection region 160 is located closer to the pump access opening than the bayonet connection region 146. In one or more embodiments, the screw connection region 160 is located in the ice maker 10 between the pump access opening and the pump 62. As will be explained in further detail below, the screw connection region 160 is configured to secure a side of the pump 62 opposite from the bayonet connection region 146 to the sump 60 using one or more screws or other threaded or mechanical fasteners. In an exemplary embodiment, the respective side of the pump 62 can be secured to the screw connection region 160 using a single screw (not show).

The screw connection region 160 comprises a pad 162 projecting radially from the mounting collar 142 on the opposite side of the mounting collar from the bayonet connection region 146 (broadly, the screw connection region is spaced apart from the bayonet connection region about the pump opening). A stop 164 extends upward from the pad 162 along one end portion thereof. The illustrated screw connection region 146 includes a gap 166 that extends along the pad 148 between the adjacent rail 144 and the stop 164. As will be explained in further detail below, during use, a screw-receiving element of the water pump 62 is configured to be positioned on the pad 148 in the gap 166 when the bayonet element of the pump is received in the gap 151 of the bayonet connection region 146. When the pump is rotated so that the bayonet element is received in the bayonet slot 156, the screw-receiving element moves toward the stop 164. The screw connection region 160 includes a screw hole 168 by which a single screw (not shown) can fasten the screw-receiving element of the pump 62 to the screw connection region to secure the side of the pump located near the pump access opening to the sump 70.

Figure 8:
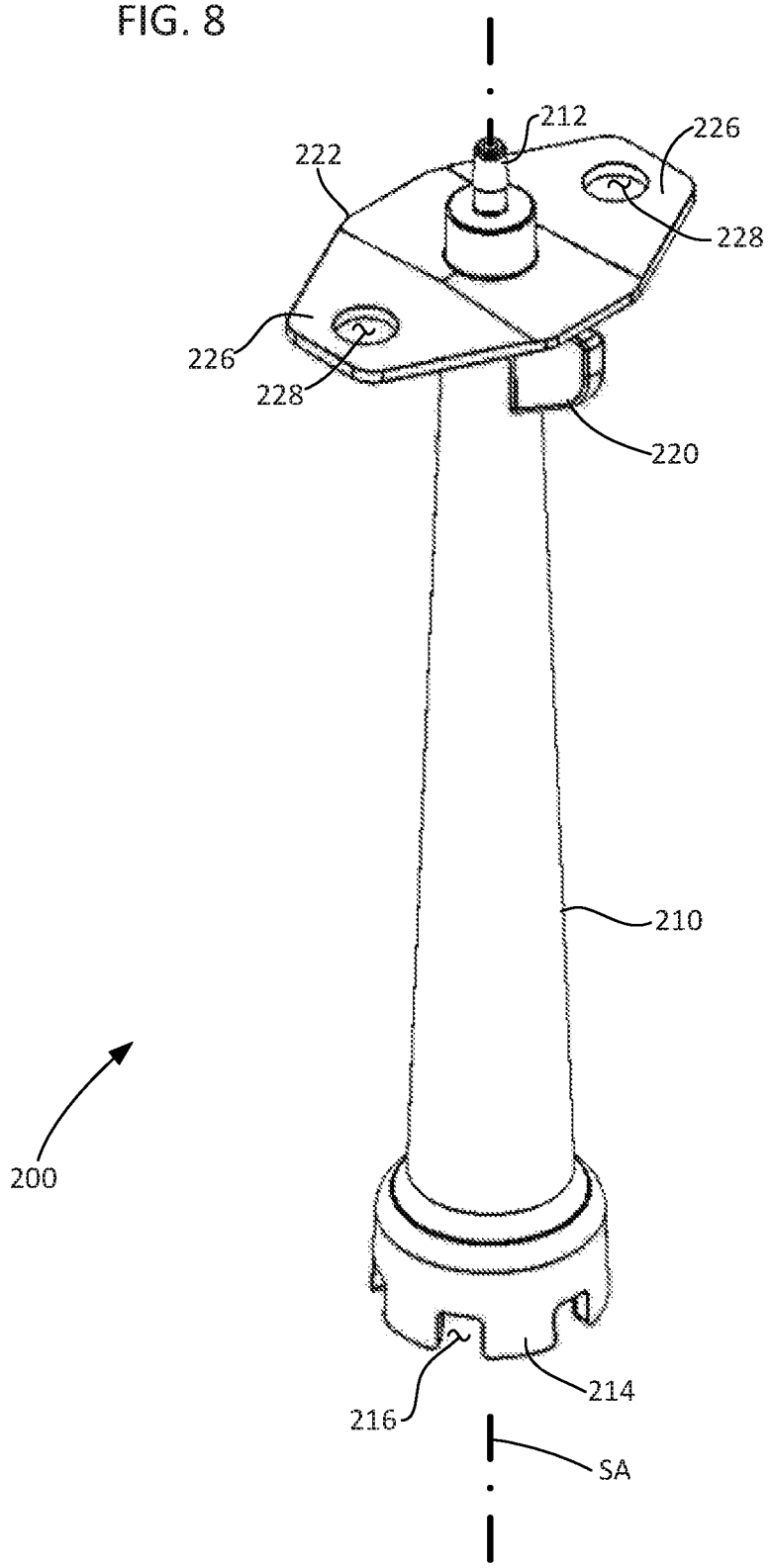
FIG. 8 is a perspective of the fitting of the water level sensor.
Figure 9:
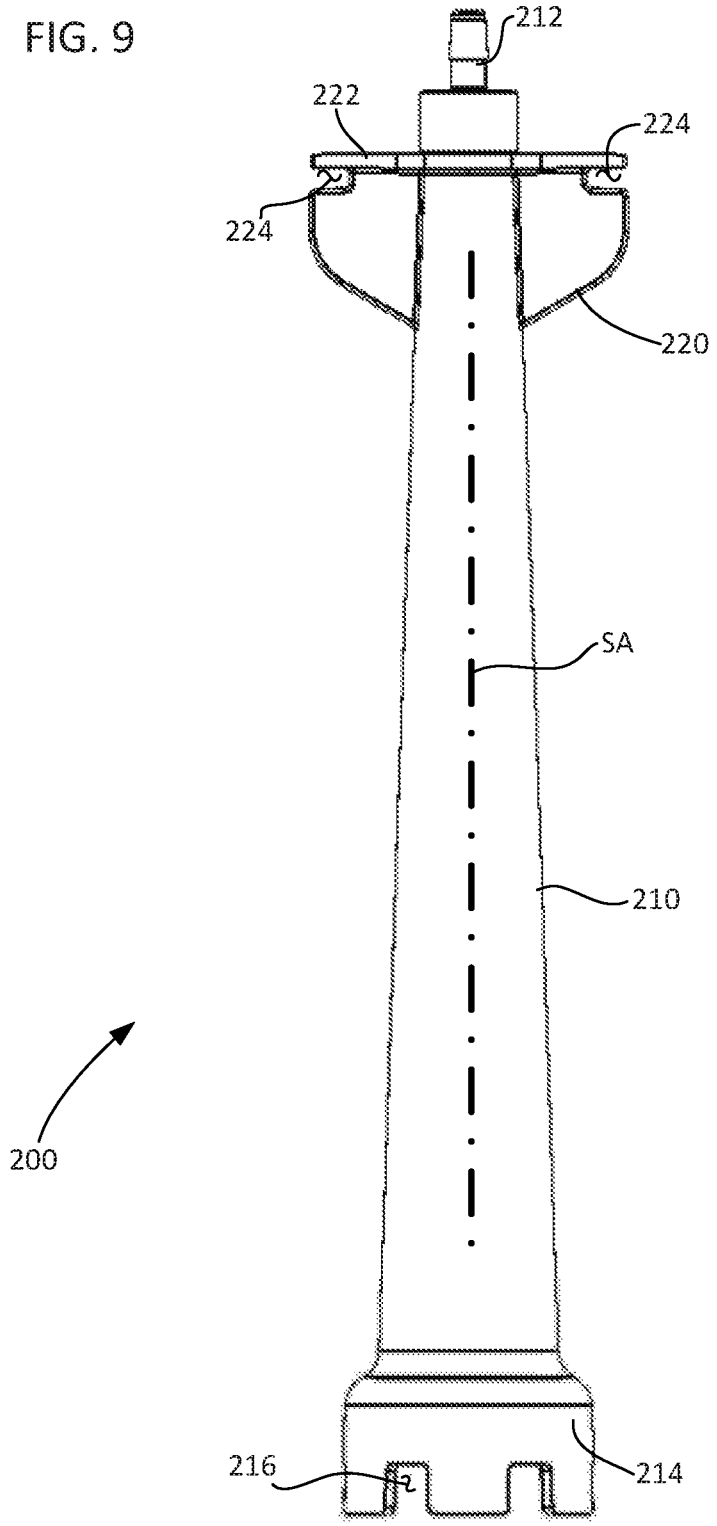
FIG. 9 is an elevation of the fitting.

Referring to FIGS. 5 and 8-9, in an exemplary embodiment, the water level sensor 90 comprises a remote air pressure sensor. It will be understood, however that any type of water level sensor may be used in ice maker 10 including, but not limited to, a float sensor, an acoustic sensor, or an electrical continuity sensor without departing from the scope of the disclosure. The water level sensor 90 includes a fitting 200 that is configured to lockingly engage the sensor mount 110 to connect the sensor to the sump 70. In the illustrated embodiment, the fitting 200 also functions as an air fitting that fluidly connects a pneumatic tube 202 the bottom of the sump 70. The pneumatic tube 202 is configured to provide fluid communication between the fitting 200 and an air pressure sensor 204 (FIG. 1) used to detect the water pressure proximate the bottom of sump 70. The water pressure proximate bottom 72 of sump 70 is related to the water level in sump 70. Thus, using the output from air pressure sensor 204, the processor 82 can determine the water level in sump 70. Additional details of exemplary embodiments of a water level sensor comprising a remote air pressure sensor are described in U.S. Patent Application Publication No. 2016/0054043, which is hereby incorporated by reference in its entirety.

Referring to FIGS. 8 and 9, the fitting 200 comprises a shaft 210 that extends along a shaft axis SA from a proximal end portion that defines a nipple 212 (broadly, a coupler) for fluidly coupling the fitting to the pneumatic tube 202 to a distal end portion that defines a base 214 configured to engage the bottom wall of the sump tank 70A of the sump 70. One or more openings 216 are formed in the perimeter of base 214. The openings 216 provide fluid communication between the bottom of the sump 70 and a chamber inside the fitting 200. As the water level in the sump 70 increases, the pressure of the water proximate bottom 72 of sump 70 is communicated to the fitting 200 through the openings 216 and is in turn communicated through the pneumatic tube 202 to the air pressure sensor 204. The controller 80 can thus determine the water level in sump 70. Additionally, as the water level in sump 70 decreases, the pressure in chamber 92 also decreases. This pressure decrease is communicated pneumatically through the tube 202 to air pressure sensor 204. Controller 80 can thus determine the water level in the sump.

The fitting 200 of the water level sensor 90 includes features that lockingly engage the sensor mount 110 to mechanically connect the sensor to the sump 70. Although the illustrated fitting 200 serves as both an air fitting and a mechanical connector of the sensor 90, it will be understood that a fitting can function as a mechanical connector without also serving as an air fitting in one or more embodiments. For example, it is contemplated that the locking features of the fitting 200 can be used with fittings of other types of sensors (e.g., other types of water level sensors, pressure sensors, temperature sensors, etc.) to mechanically connect the sensor to an ice maker in operative position for sensing.

Referring still to FIGS. 8 and 9, in one or more embodiments, at least one bayonet arm 220 extends radially outward from the shaft 210 with respect to the shaft axis SA at a location spaced apart between the nipple 212 and the base 214. Suitably, each bayonet arm 220 protrudes radially of the shaft axis SA beyond a radially outermost portion of the shaft 210 (e.g., the base 214). In the illustrated embodiment, each bayonet arm 220 comprises a generally flat tab that extends in a vertically and radially oriented plane. The bayonet arms can have other configurations in one or more embodiments. The outer end portion of each bayonet arm 220 is sized and arranged to be passable through a corresponding one of the bayonet slots 124 when the fitting 200 is inserted into the sensor opening 120 of the sensor mount 110. In the illustrated embodiment, the fitting 200 includes two bayonet arms 220 at diametrically opposite (broadly, angularly spaced) positions with respect to the shaft axis SA. In one or more embodiments, the fitting can have other numbers and arrangements of bayonet arms.

The illustrated fitting 200 further comprises a flange 222 that extends radially outward from the shaft 210 at a location proximally spaced from the bayonet arms 220 along the shaft axis SA. A gap 224 (FIG. 9) extends along the axis SA between at least the outer end portion of each bayonet arm 220 and an overlying portion of the flange. As shown in FIG. 8, the illustrated flange 222 includes diametrically spaced (broadly, angularly spaced) extension portions 226 that protrude radially of the shaft axis SA at locations that are angularly offset from the bayonet arms 220 about the shaft axis. In the illustrated embodiment, each extension portion 226 defines a recess 228 configured to receive a respective detent 126 when the fitting 200 is lockingly engaged with the sensor mount 110 to connect the water level sensor 90 to the sump 70. The recesses 228 are angularly offset from the bayonet arms 220 about the shaft axis SA in the illustrated embodiment Referring to FIGS. 10-13, the fitting 200 is configured to be lockingly engaged with the sensor mount 110 to releasably connect the water level sensor 90 to the ice maker 10 at a sensing position in which the water level sensor is configured to detect the amount of water in the reservoir. In one or more embodiments, the fitting 200 is configured to be lockingly engaged with the sensor mount by a bayonet connection. In certain embodiments, the locking engagement between the fitting 200 and the sensor mount 110 is configured to mount the fitting on the ice maker 10 at the sensing position without the use of any additional fasteners.

Figure 10:
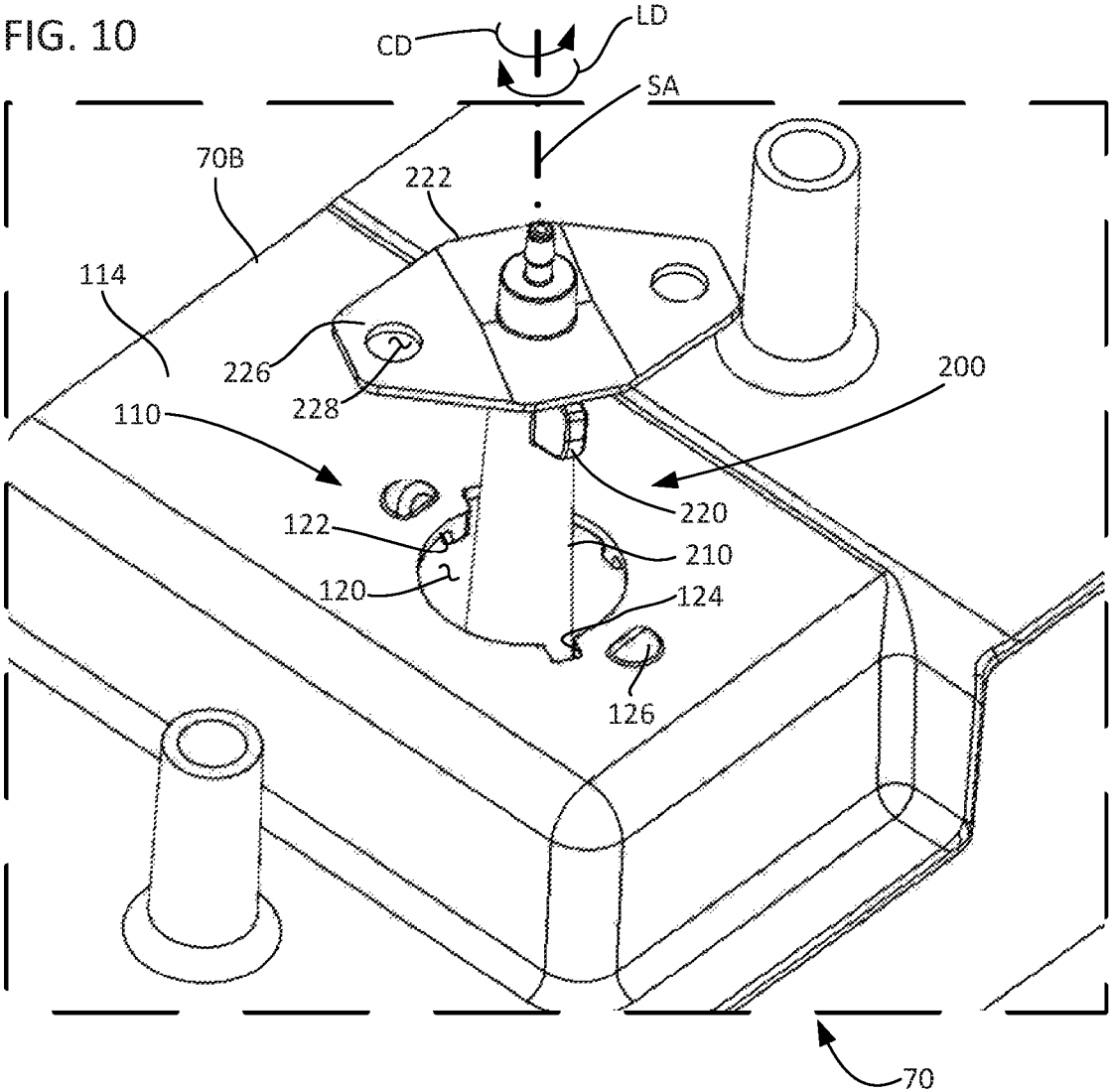
FIG. 10 is an enlarged perspective of a portion of the sump assembly including the sensor mount and the fitting, illustrating the fitting partially inserted into the sensor mount.
Figure 11:
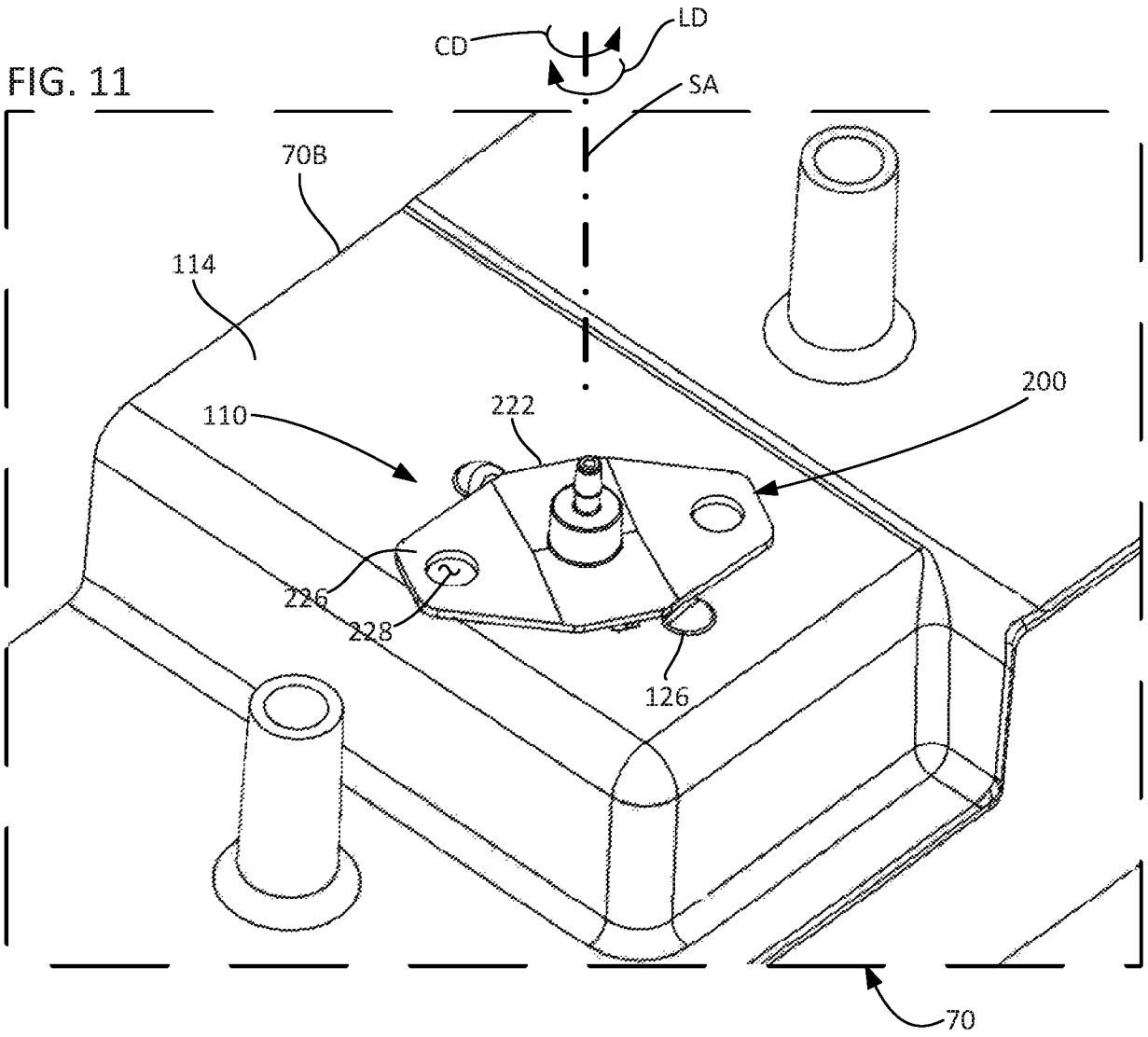
FIG. 11 is an enlarged perspective similar to FIG. 10, illustrating the fitting fully inserted into the sensor mount at a first rotational position in which the fitting can be withdrawn from the sensor mount.

To mount the fitting 200 on the sensor mount, initially the base 214 is inserted into the central portion 122 of the sensor opening 120. As shown in FIG. 10, the fitting 200 is rotated to a first rotational position about the shaft axis in which the bayonet arms 220 are aligned with the bayonet slots 124 of the sensor opening 100. The fitting 200 is inserted further such that the bayonet arms 220 pass through the slots 124 and the flange 222 engages the top of the mounting plate 114, as shown in FIG. 11. In this position, the gaps 224 overlap the mounting plate 114 along the shaft axis SA. While the fitting 200 is in the first rotational position, the recesses 228 are angularly offset from the detents 126 about the shaft axis SA in the counter-rotational direction CD. Further, the counter-rotation stops 130 directly oppose the bayonet arms 220 to inhibit rotation of the fitting 200 in the counter-rotational direction CD.

Figure 12:
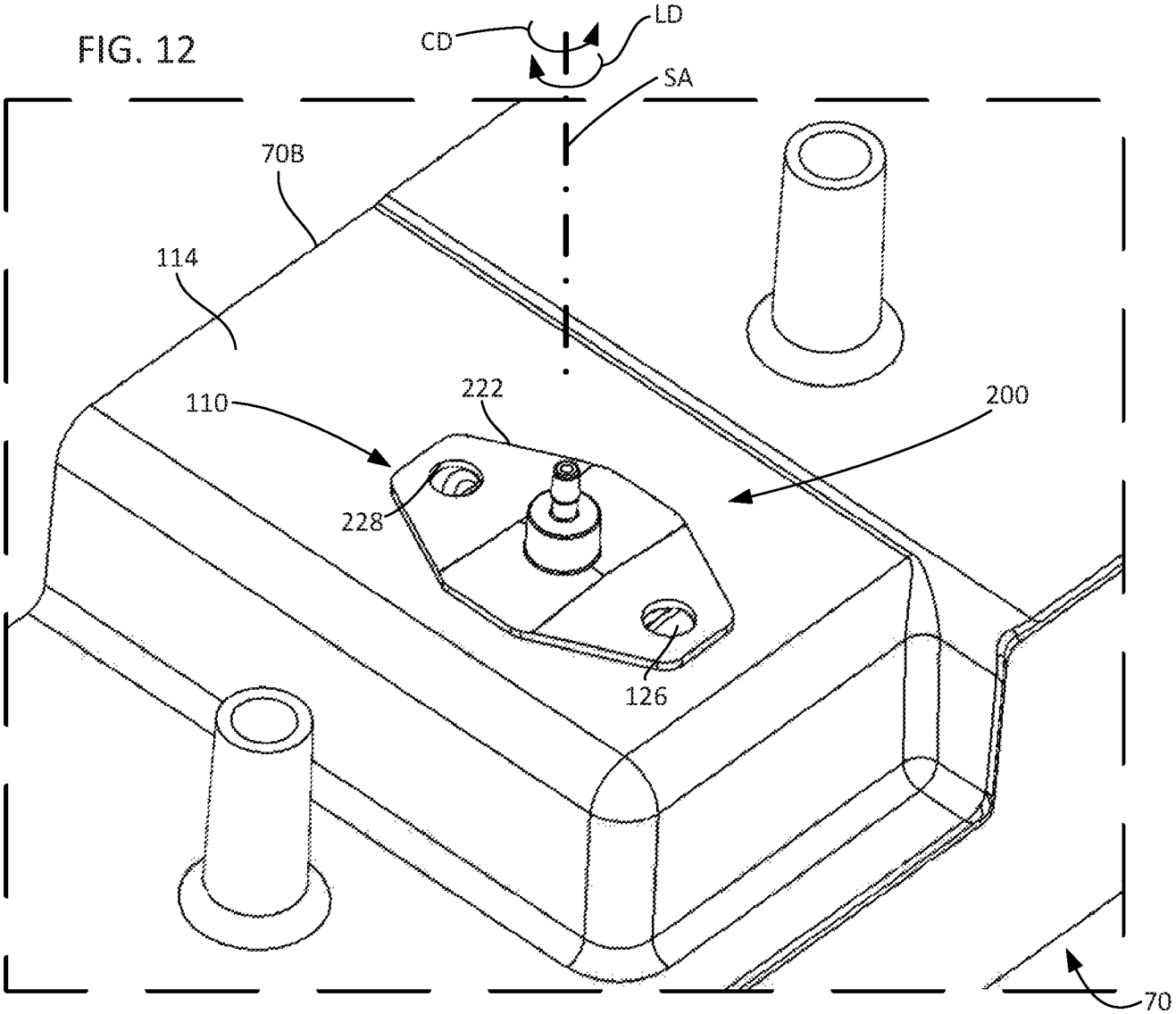
FIG. 12 is an enlarged perspective similar to FIGS. 10 and 11, illustrating the fitting fully inserted into the sensor mount at a second rotational position in which the fitting is lockingly engaged with the sensor mount.
Figure 13:
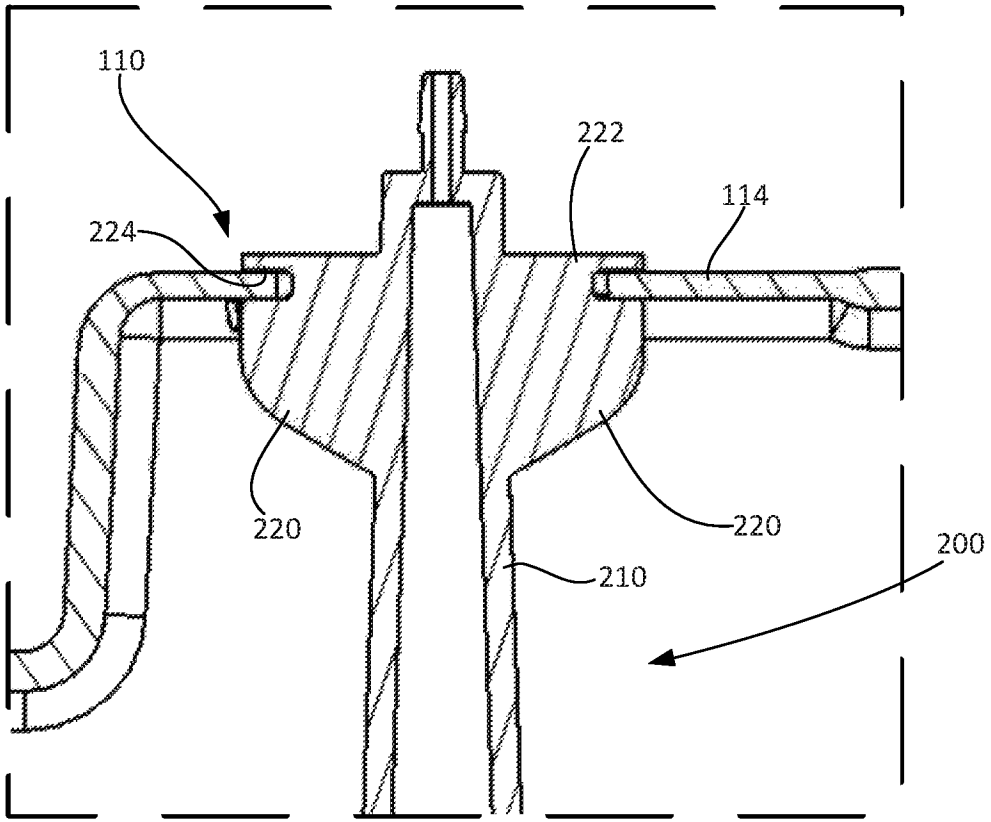
FIG. 13 is a cross section taken in the plane of line 13-13 of FIG. 4.

After moving the fitting 200 to the position shown in FIG. 11, the fitting is rotated about the shaft axis SA in the locking rotational direction LD to a second-rotational position shown in FIG. 12 to establish a bayonet connection between the fitting and the sensor mount 110. As the fitting rotates in the locking rotational direction LD, the extension portions 226 ride over the detents 126 until the detents snap into the recesses 228, as shown in FIG. 12. The detents 126 thus retain the flange 222 to provide a restraint against rotation of the fitting 200 away from the second rotational position. The over-rotation stops 128 also oppose the bayonet arms 220 to inhibit the fitting 200 from rotating beyond the second rotational position in the locking rotational direction LD. (The resistance provided by the over-rotation stops 128 provides an indication to a user to rotate the fitting 200 in the counter-rotational directional CD when the fitting is to be removed from the mount 110 after installation.) As shown in FIG. 13, after rotating to the second rotational position, portions of the mounting plate 114 are captured in the gaps 224 between the bayonet arms 220 and the flange 222. This provides a bayonet connection that inhibits the fitting 200 from withdrawing from the sensor opening 120 without first rotating in the counter-rotational direction CD back to the first rotational position.

Referring to FIG. 5, in the illustrated embodiment, when the bayonet connection is made between the fitting 200 and the sensor mount 110, the base 214 engages the bottom wall of the sump tank 70A of the sump so that the pressure at the bottom of the sump is communicated through the openings 216 and the air chamber inside the fitting 200 and further through the pneumatic tube 202 to the air pressure sensor 204. Accordingly, the fitting 200 can operatively connect the water level sensor 90 to the sump 70 without the use of fasteners or tools. Further, the fitting 200 can be released from the sensor mount 110 without using tools by simply rotating the fitting in the counter-rotational direction CD until the bayonet arms 220 align with the bayonet slots 124. Then the fitting 200 can be withdrawn from the sensor opening 120.

Referring still to FIG. 5, the illustrated pump 62 comprises a pump motor 250 and a pump intake assembly 252. The pump intake assembly is configured to be fluidly coupled to the water line 63, and the pump motor 250 is configured to pump water from the sump 70 through the pump intake assembly and the water line. One or components of the pump intake assembly 252 can be attached to the pump motor 250 such that the pump 62 can be installed in the sump assembly 60 and removed from the sump assembly as a unit.

Figure 14:
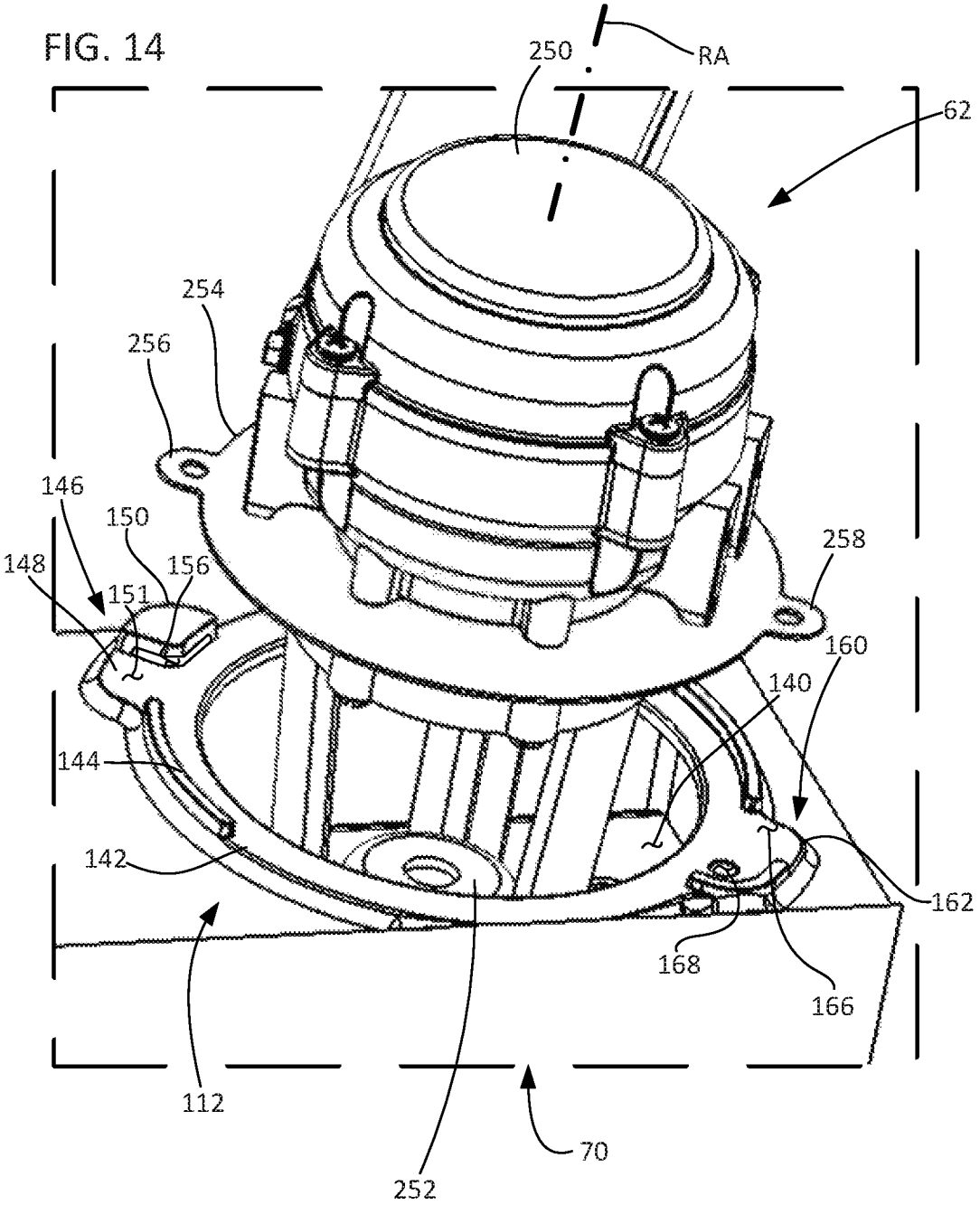
FIG. 14 is an enlarged perspective of a portion of the sump assembly including the pump mount and the water pump, illustrating the water pump partially inserted into the pump mount.

Referring to FIG. 14, the pump 62 further comprises a mounting flange 254. The mounting flange 254 is generally circular and located along a height of the pump between an upper portion of the pump motor 250 and a lower portion of the pump intake assembly 252. The circular portion of the mounting flange 254 is configured to be received between the rails 144 of the pump mount 112 and slidably engaged with the collar 142. The rails 144 constrain the flange 254 to move in rotation about a rotational axis RA with respect to the mounting plate 114. A bayonet arm 256 protrudes radially from the flange 254. The bayonet arm 256 is configured to be received in the bayonet connection region 146 of the pump mount 112 for forming a bayonet connection between one side of the pump 62 and the sump 70. A screw arm 258 protrudes radially from the flange 254 at a location diametrically opposite (broadly, angularly spaced) from the bayonet arm 256. The screw arm 258 is configured to be received in the screw connection region 160 of the pump mount 112 for forming a screw connection between the sump 70 and the side of the pump opposite the bayonet arm 256. In one or more embodiments, the bayonet arm 256 and the screw arm 258 are substantially identical such that the flange 254 can be installed in the pump mount 112 in reversible orientations.

Figure 15:
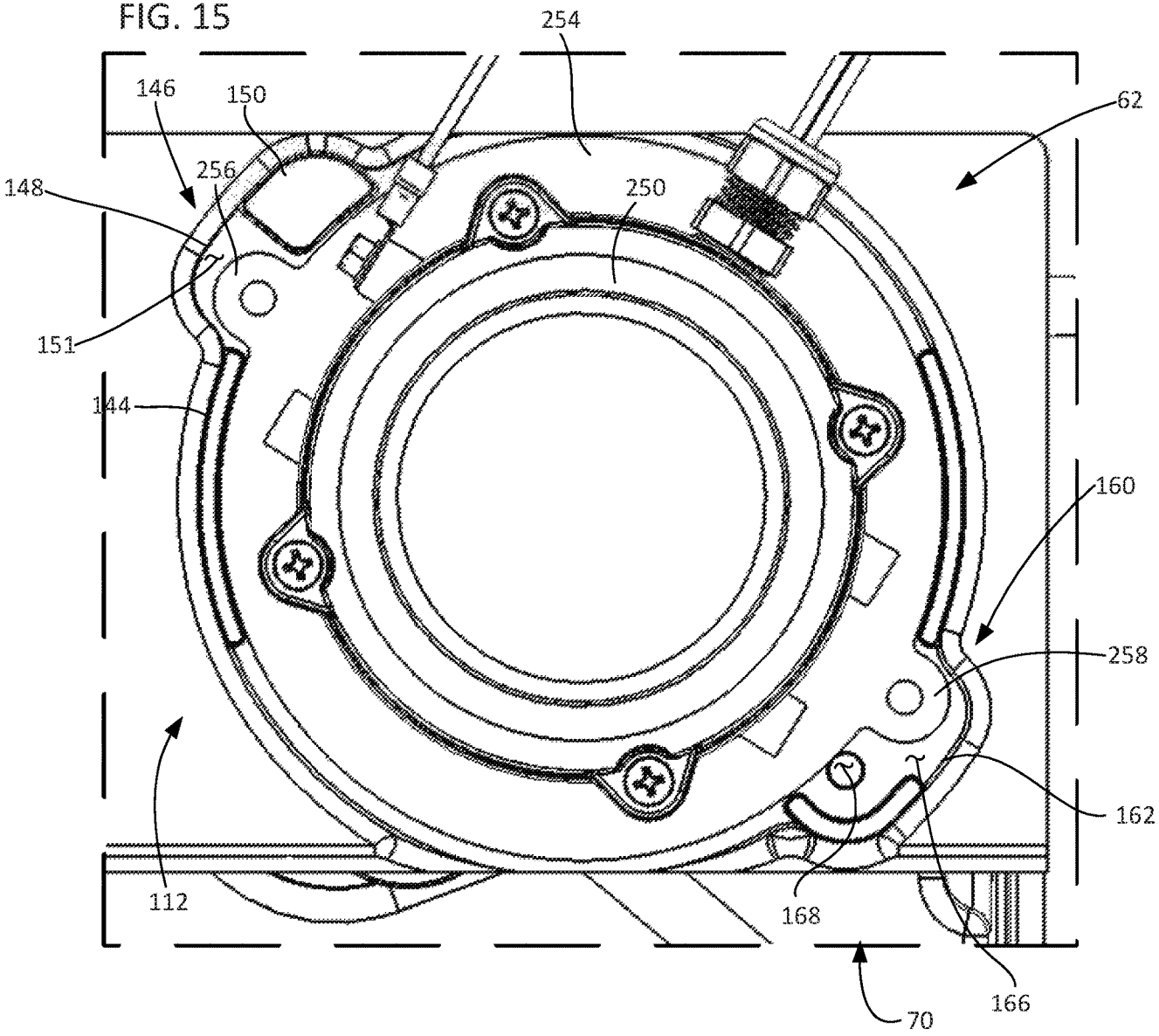
FIG. 15 is a top plan view of a portion of the sump assembly including the pump mount and the water pump, illustrating the water pump at a first rotational position in which the water pump can be withdrawn from the pump mount.
Figure 16:
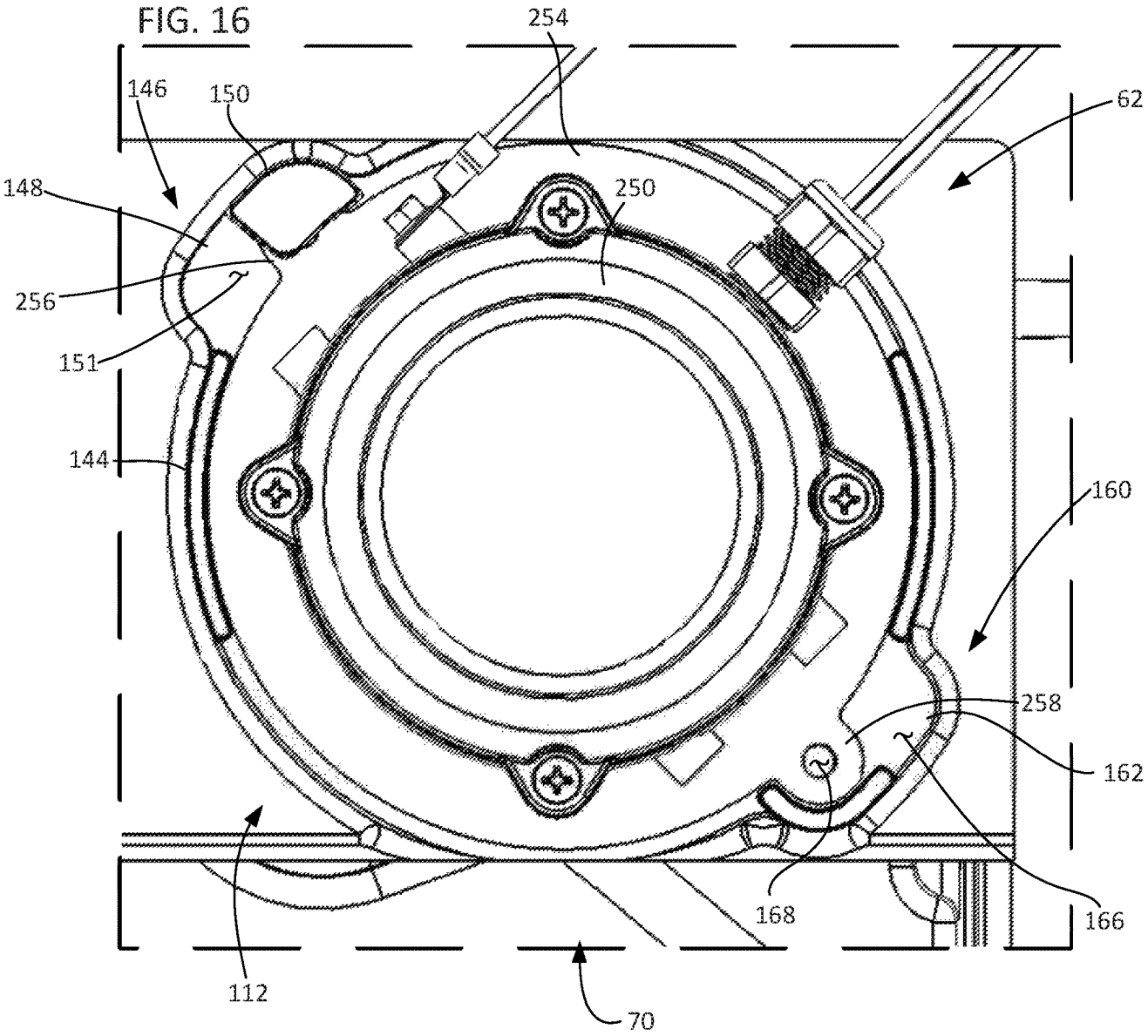
FIG. 16 is a top plan view similar to FIG. 15, illustrating the water pump at a second rotational position in which the water pump is connected to the pump mount by a bayonet connection.
Figure 17:
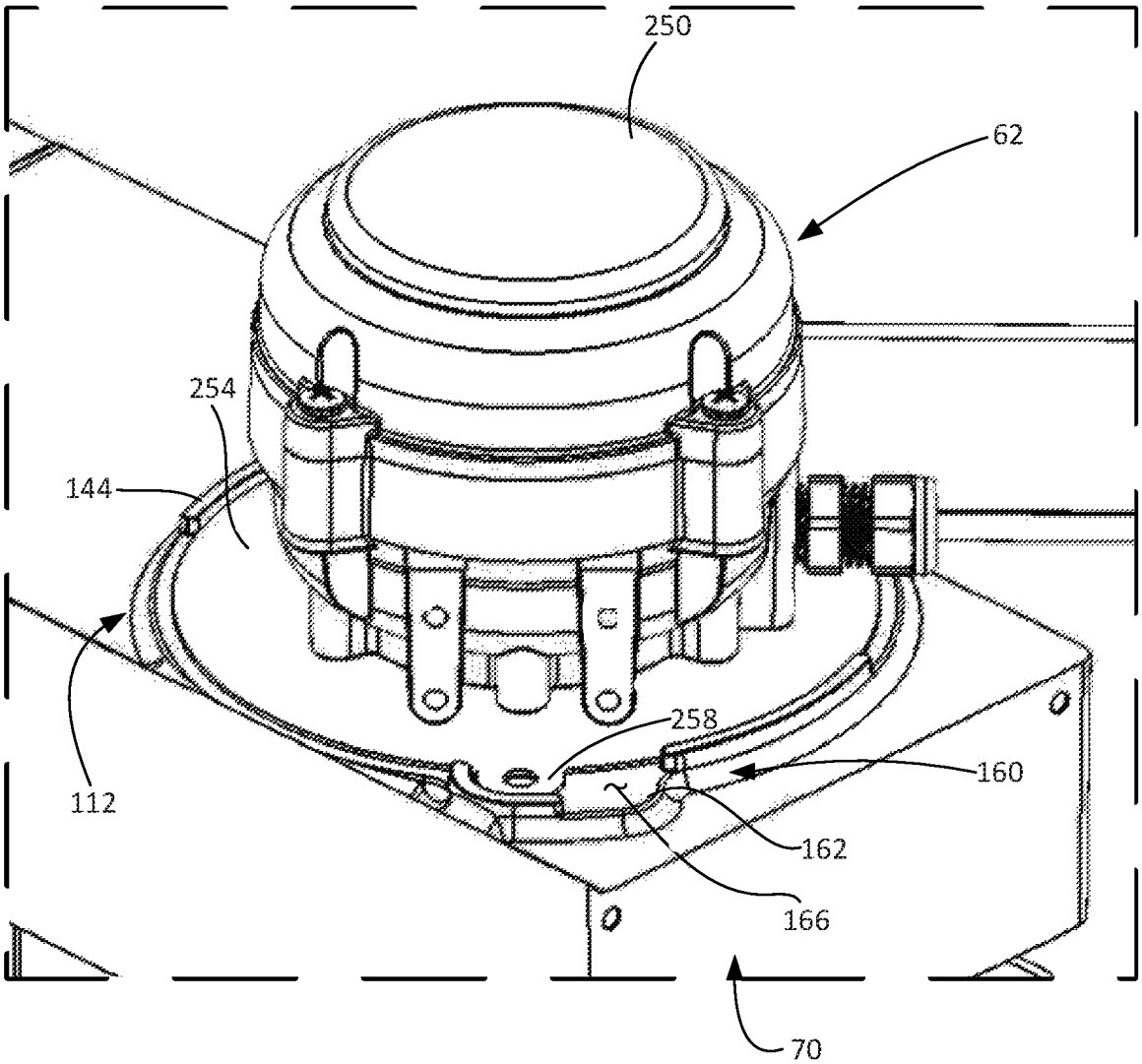
FIG. 17 is an enlarged perspective of a portion of the sump assembly including the pump mount and the water pump, illustrating the water pump installed in the pump mount.
Figure 18:
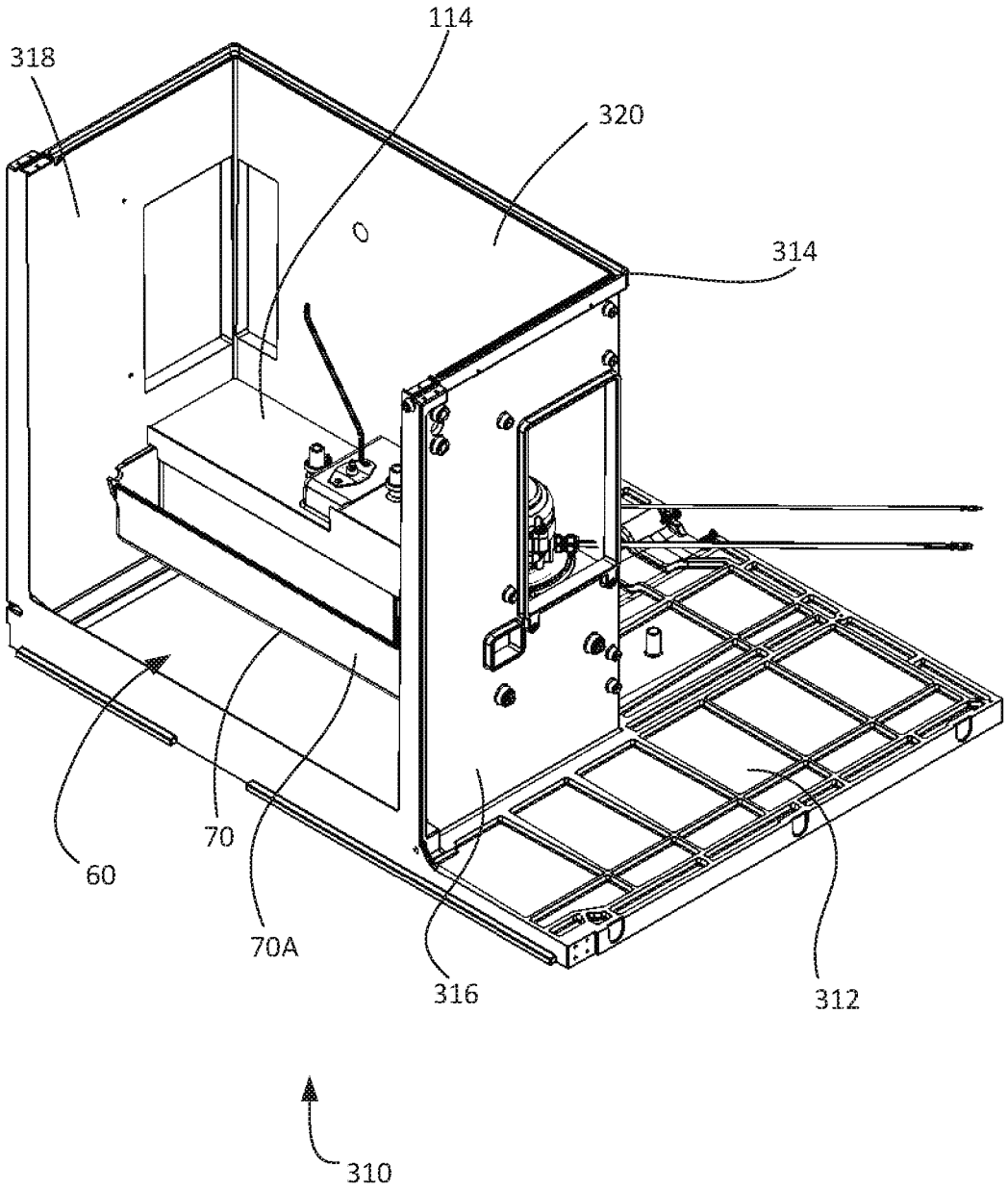
FIG. 18 is a perspective of the sump assembly connected to a sump assembly support.

To install the pump 62 in the pump mount 112, initially the pump access panel 29A is removed from the cabinet 29 (FIG. 2) to expose the pump access opening. The pump is inserted through the pump access opening toward the pump mount 110. The pump intake assembly 252 is then inserted through the pump opening 140 as shown in FIG. 14, and the pump is rotated to a first rotational position about the rotational axis RA shown in FIGS. 14 and 15. In the first rotational position, the bayonet arm 256 overlaps the gap 151 of the bayonet connection region 146 and the screw arm 258 overlaps the gap 166 of the screw connection region 160. Thus, the mounting flange 254 can be placed onto the collar 142 between the rails 144, and the arms 256, 258 can be received on the respective pads 148, 162 in the gaps 151, 166. The pump 62 is then rotated about the rotational axis RA as a unit to a second rotational position shown in FIGS. 16 and 17. The flange 154 slides along the collar 142 and rails 144 bear against the edge of the flange to maintain the pump 62 in alignment with the pump opening 140.

As the pump 62 rotates to the second rotational position, the bayonet arm 256 slides into the bayonet slot 156 to establish a bayonet connection between the pump mount 112 and the pump on the side of the pump that is remote from the pump access opening. No tools or fasteners are required to connect the remote side of the pump 62 to the pump mount 112. As the pump rotates to the second rotational position, the screw arm slides along the pad 162 of the screw connection region until it overlies the screw hole 168. A single screw (not shown) is threadbly inserted through the screw arm 258 into the screw hole 168 to fasten the near side of the pump 62 to the pump mount 112. A technician can install and remove the single screw with relative ease because the screw connection region 160 is readily accessible through the pump access opening of the cabinet 29. Together the bayonet connection and the screw connection securely mount the pump 62 on the sump 70. The connections hold the pump 62 in place as it pumps water through the water system of the ice maker 10.

As can be seen, the illustrated ice maker 10 includes mounts 110, 112 that facilitate releasably connecting a water pump and a water level sensor on the sump 70 with minimal use of tools and fasteners. The mounts 110, 112 are thought to simplify the process of removing and reinstalling the sensor fitting 200 and pump 62 when necessary for repair or maintenance.

Referring to FIGS. 18-20A, in one or more embodiments, the ice maker 10 comprises a sump assembly support 310 that is configured to support the sump assembly 60 inside the ice maker 10. The inventors have recognized that ice maker control schemes that use the water level as a control input require accurate placement of the water level sensor in the sump. If the position of the water level sensor deviates from the specified position by even a small amount (e.g., millimeters or less), the control scheme can be disrupted. The inventors have further recognized that the aggregated dimensional tolerances of the parts of conventional assemblies for mounting the components of an ice maker water system can cause a water level sensor to be offset from the expected position by an amount that adversely affects water level-based control. As will be explained below, the illustrated sump assembly support 310 includes portions that define integral connectors that position the mounting plate 114 with respect to the sump tank 70A so that the sensor fitting 200 and the pump 62 are precisely positioned at their specified positions with respect to the sump tank when they are installed in the mounts 110, 112.

Figure 19:
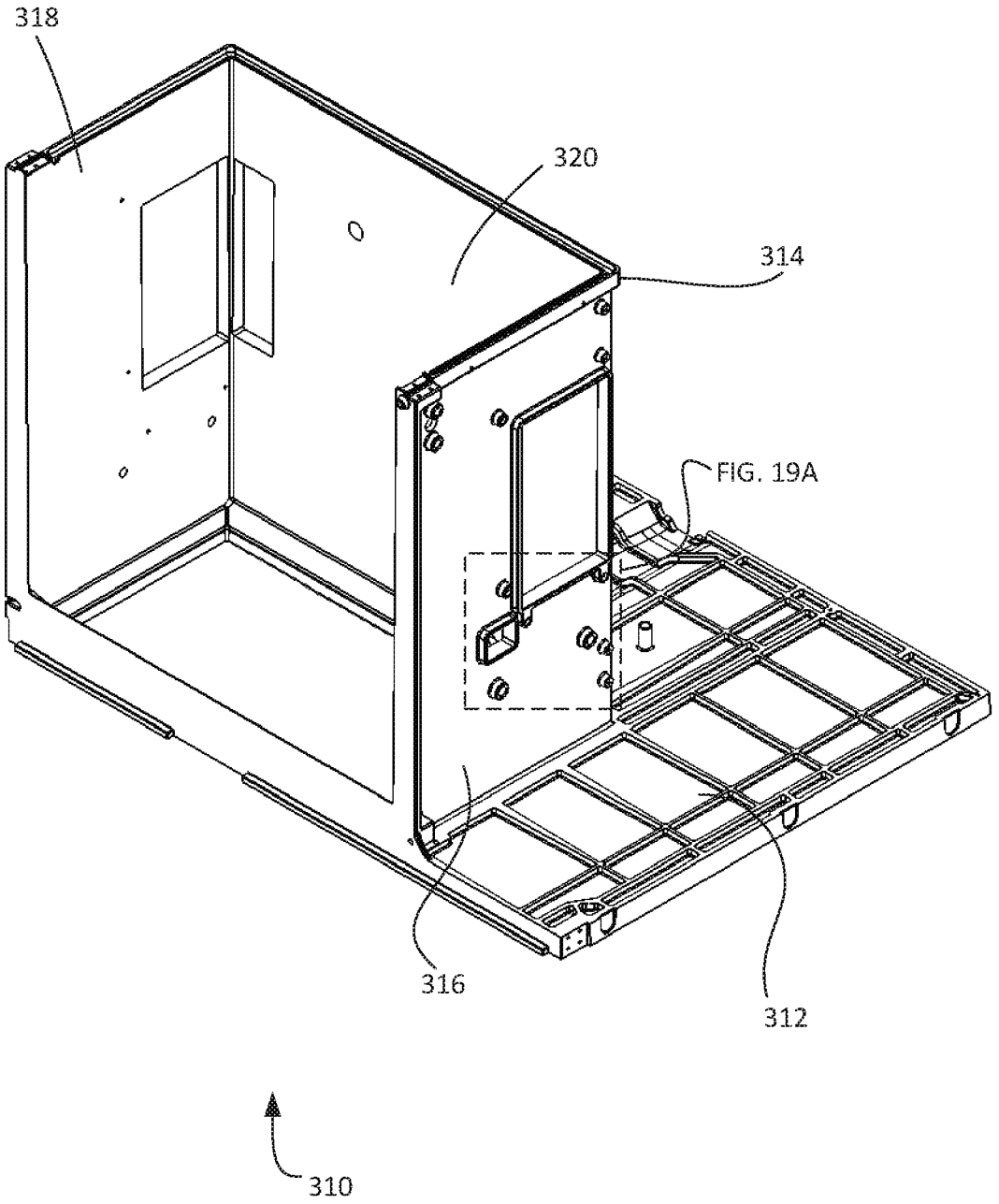
FIG. 19 is a perspective of the sump assembly support.
Figure 19A:
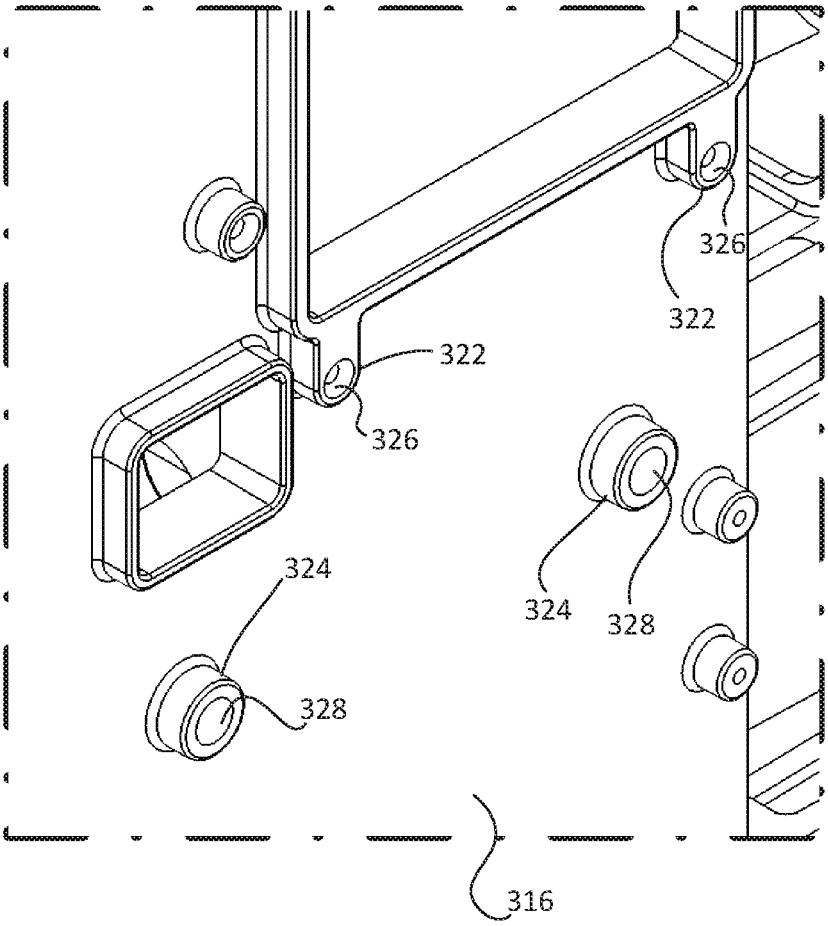
FIG. 19A is an enlarged view of a portion of FIG. 19.
Figure 20:
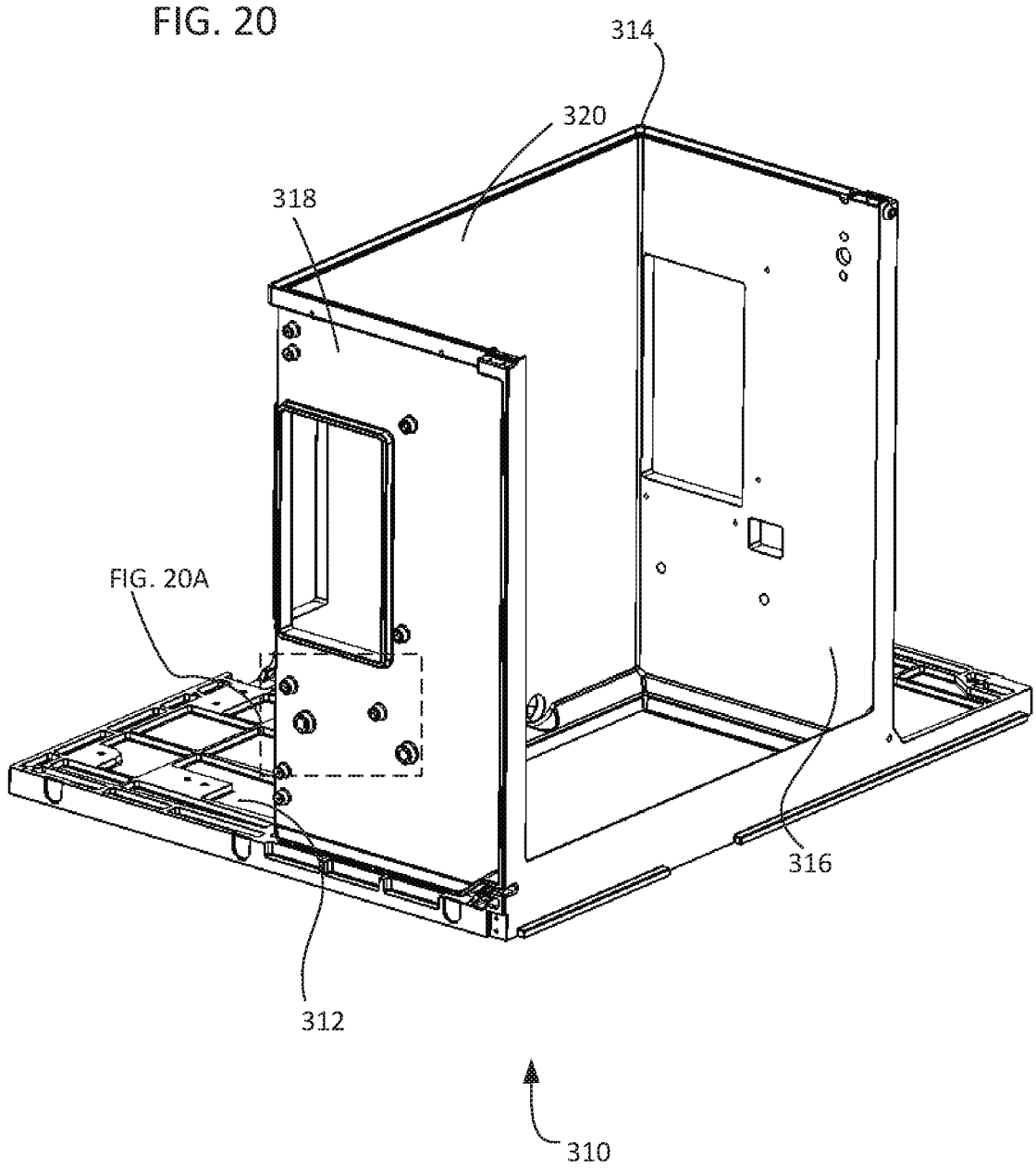
FIG. 20 is another perspective of the sump assembly support.
Figure 20A:
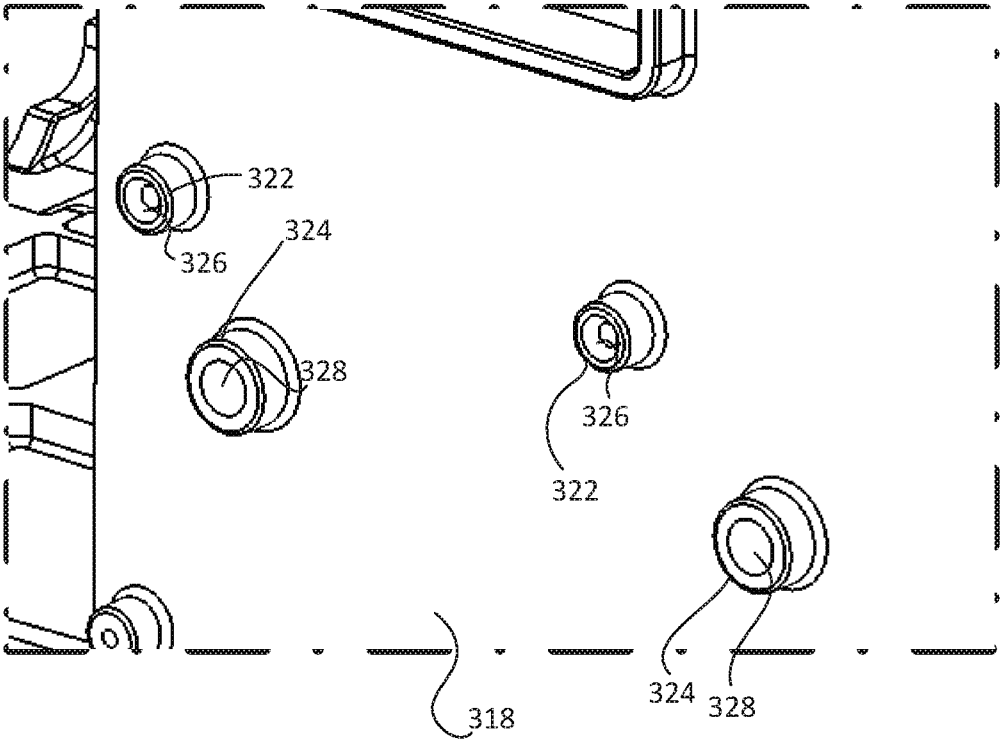
FIG. 20A is an enlarged view of a portion of FIG. 20.

In the illustrated embodiment, the sump assembly support 310 includes a base 312 and a vertical support wall 314. The illustrated vertical support wall 314 comprises a first side wall portion 316, a second side wall portion 318, and a back wall portion 320 extending laterally between the first and second side wall portions. As shown in FIGS. 19A and 20A, each side wall portion 316, 318 includes at least one integral upper connector 322 (broadly, a first connector) configured for connecting the mounting plate 114 to the support 310 and at least one integral lower connector 324 configured for connecting the sump tank 70A to the support.

At least one wall portion 316, 318 of the support 310 that defines both the upper connectors 322 and the lower connectors 324 is formed from a single monolithic piece of material. For example, in one or more embodiments, the entire vertical support wall 314 is formed from a single monolithic piece of material. In the illustrated embodiment, the entire support 310, including the base 312 and the vertical support wall 314, is formed from a single piece of monolithic material. In one or more embodiments, the support 310 is a single molded piece. In the illustrated embodiment, the monolithic support 310 is formed by compression molding.

In the illustrated embodiment, each upper connector 322 comprises a projection that defines a tapered screw hole 326, and each lower connector 324 comprises a projection that defines a mounting hole 328. Referring to FIG. 7, each end portion of the mounting plate 114 defines a pair screw holes 330 that are configured to be aligned with the upper screw holes 326. Screws (broadly, mechanical fasteners; not shown) pass through the screw holes 326 and thread into the screw holes 330 to connect the mounting plate 114 to the support 310 precisely at the specified position along the height of the support 310. In one or more embodiments, countersunk screws (e.g., screws with tapered heads) are used to connect the mounting plate 114 to the support 310. The countersunk screws self-center in the tapered screw holes 326.

Figure 21:
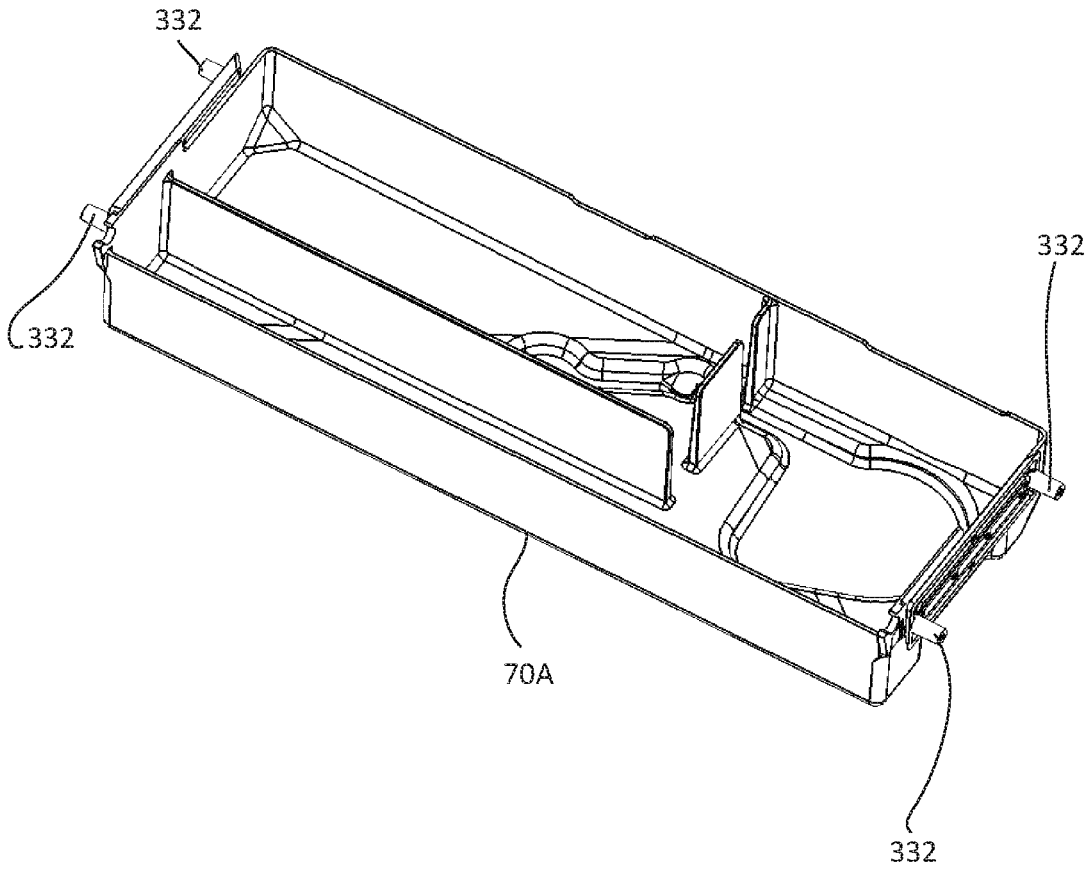
FIG. 21 is a perspective of a sump tank of the sump assembly.

As shown in FIG. 21, in one or more embodiments, each end of the sump tank 70A includes a pair of projections 332 at spaced apart locations. In the illustrated embodiment, each projection 332 is configured to be received in a respective one of the mounting holes 328 of a respective side wall portion 316, 318 (broadly, each projection 332 is configured to be aligned with a respective connector 324). The projections 332, by being received in the mounting holes 328, position the sump tank 70A at precisely the specified position along the height of the support 310. In addition, a screw is inserted through the mounting hole 328 and threaded into each projection 332 to fasten the sump tank 70A onto the support 310 at the specified position.

The integral connectors 322 thus ensure the mounting plate 114 attaches to the support 310 at the specified position, and the integral connectors 324 ensure the sump tank 70A attaches to the support at the specified position. The support 310 thereby positions the mounting plate 114 with respect to the sump tank 70A so that the fitting 210 is precisely positioned for the water level sensor 90 to accurately detect the water level in the sump 70 when the fitting is mounted on the sensor mount 110. Likewise, the support 310 positions the mounting plate 114 with respect to the sump tank 70A so that the pump 62 is precisely positioned for pumping water from the sump 70 through the ice maker 10 when the pump is mounted on the pump mount 112.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

What is claimed is:

1. An ice maker for forming ice, the ice maker comprising:

a refrigeration system comprising an ice formation device;

a water system for supplying water to the ice formation device, the water system comprising a water reservoir configured to hold water to be formed into ice, passaging providing fluid communication between the water reservoir and the ice formation device, and a water level sensor for detecting an amount of water in the reservoir, the water level sensor including a fitting; and a sensor mount for mounting the fitting of the water level sensor on the ice maker at a sensing position in which the fitting connect the water level sensor to the reservoir for detecting the amount of water in the reservoir;

wherein the sensor mount is configured to be lockingly engaged with the fitting to releasably mount the fitting on the ice maker at the sensing position;

wherein the sensor mount comprises a mounting plate defining a sensor opening, the fitting configured to be received in the sensor opening;

wherein the fitting comprises a shaft extending along a shaft axis from a proximal end portion to a distal end portion, a bayonet arm extending radially outward from the shaft, and a flange extending radially outward from the shaft at a location proximally spaced from the bayonet arm such that a gap extends along the shaft axis between the bayonet arm and the flange.

2. The ice maker as set forth in claim 1, wherein locking engagement between the sensor mount and the fitting is configured to releasably mount the fitting on the ice maker without any additional fasteners.

3. The ice maker as set forth in claim 1, wherein the fitting is lockingly engageable with the sensor mount by a bayonet connection.

4. The ice maker as set forth in claim 1, wherein the sensor opening is configured such that, when the fitting is in a first rotational position about the shaft axis, the fitting is passable into the opening by movement along the shaft axis until the flange engages the mounting plate.

5. The ice maker as set forth in claim 4, wherein when the flange engages the mounting plate, the fitting is rotatable about the shaft axis from the first rotational position in a locking rotational direction to a second rotational position in which a portion of the mounting plate is captured in the gap between the flange and the bayonet arm.

6. The ice maker as set forth in claim 5, wherein the mounting plate comprises a detent configured to engage the flange when the fitting is in the second rotational position to retain the fitting at the second rotational position such that the detent inhibits the fitting from rotating about the shaft axis when at the second rotational position.

7. The ice maker as set forth in claim 6, wherein the flange includes a recess configured to receive the detent when the flange is in the second rotational position, the recess being angularly offset from the bayonet arm about the shaft axis.

8. The ice maker of claim 4, wherein the sensor opening comprises a bayonet slot through which the bayonet arm is passable to from a location above the mounting plate to a location below the mounting plate as the fitting moves along the shaft axis until the flange engages the mounting plate.

9. The ice maker as set forth in claim 5, wherein the mounting plate comprises a counter-rotation stop configured to inhibit rotation of the fitting about the shaft axis from the first rotational position in a counter-rotational direction away from the second rotational position.

10. The ice maker as set forth in claim 5, wherein the mounting plate comprises an over-rotation stop configured to inhibit rotation of the fitting about the shaft axis from the first rotational position beyond the second rotational position.

11. The ice maker as set forth in claim 1, wherein the bayonet arm is planar and extends in a first plane parallel to the shaft axis and the flange is planar and extends in a second plane perpendicular to the shaft axis.

12. The ice maker as set forth in claim 1, wherein the shaft, the bayonet arm, and the flange are formed integrally as a single piece.

13. An ice maker for forming ice, the ice maker comprising:

a refrigeration system comprising an ice formation device;

a water system for supplying water to the ice formation device, the water system comprising a water reservoir configured to hold water to be formed into ice, passaging providing fluid communication between the water reservoir and the ice formation device, and a water pump configured to pump water from the water reservoir through the passaging to the ice formation device, the water pump comprising a pump motor and an intake assembly fixed to the pump motor; and a pump mount for mounting the water pump on the ice maker for pumping water from the water reservoir through the passaging, wherein the pump mount is configured to mount the water pump such that the intake assembly extends downward from the pump motor into the water reservoir;

wherein the water pump is configured to be connected to the pump mount by a bayonet connection by rotating the pump motor and the intake assembly together as a unit in relation to the pump mount.

14. The ice maker as set forth in claim 13, wherein the water pump is further configured to be connected to the pump mount by a screw.

15. The ice maker as set forth in claim 14, further comprising a housing having a pump access opening through which the water pump is accessible in the housing.

16. The ice maker as set forth in claim 15, wherein the pump mount has a bayonet connection region at which the water pump is configured to be connected to the pump mount by the bayonet connection and a screw connection region at which the water pump is configured to be connected to the pump mount by the screw, the screw connection region being closer to the pump access opening than the bayonet connection region.

17. The ice maker as set forth in claim 13, wherein the water pump comprises a mounting flange including a bayonet arm.

18. The ice maker as set forth in claim 17, wherein the pump mount comprises a mounting plate, a receiver, and a bayonet slot between the receiver and the mounting plate.

19. The ice maker as set forth in claim 18, wherein the mounting flange is configured to be slidably engaged with the mounting plate for rotation about an axis from a first rotational position in which the bayonet arm is spaced from the bayonet slot to a second rotational position in which the bayonet arm is received in the bayonet slot.

20. The ice maker as set forth in claim 17, wherein the mounting flange further comprises a screw arm spaced apart from the bayonet arm.

21. The ice maker as set forth in claim 13, wherein the pump mount comprises a mounting plate including a pump opening, wherein the water pump is configured to be connected to the pump mount by moving the pump motor and intake assembly together to insert the intake assembly downward through the pump opening until the pump engages the pump mount and then rotating the pump motor and the intake assembly together as a unit in relation to the pump mount.

22. An ice maker for forming ice, the ice maker comprising:

a refrigeration system comprising an ice formation device; and a water system for supplying water to the ice formation device, the water system comprising a water reservoir configured to hold water to be formed into ice, passaging providing fluid communication between the water reservoir and the ice formation device, a water pump configured to pump water from the water reservoir through the passaging to the ice formation device, and a water level sensor for detecting an amount of water in the reservoir;

a mounting plate connected to at least one of the water level sensor and the water pump; and a molded support comprising at least one vertically extending support wall formed from a single monolithic piece of molded material, the vertically extending support wall including first and second integrally formed connectors;

wherein the first connector is configured to attach the mounting plate to the support and the second connector is configured to attach the water reservoir to the support such that the support supports the mounting plate and the water reservoir and positions the mounting plate with respect to the water reservoir so that at least one of (a) the water level sensor connected to the mounting plate is configured to detect the amount of water in the reservoir and (b) the water pump connected to the mounting plate is configured to pump water from the water reservoir through the passaging;

wherein the vertically extending support wall comprises a first side wall portion and a second side wall portion laterally spaced apart from the first side wall portion.

23. The ice maker as set forth in claim 22, wherein the molded support is formed by compression molding.

24. The ice maker as set forth in claim 22, wherein the first and second integrally formed connectors are formed on the first side wall portion, the second side wall portion further comprising a third integrally formed connector and a fourth integrally formed connector.

25. The ice maker as set forth in claim 24, wherein the first and third integrally formed connectors are configured to mount the mounting plate between the first and second side wall portions and the second and fourth integrally formed connectors are configured to mount the water reservoir between the first and second side wall portions.

26. The ice maker as set forth in claim 25, wherein each of the second and fourth integrally formed connectors comprises a mounting hole and wherein the water reservoir comprises opposite first and second end portions, each of the opposite first and second end portions comprises a projection, the projection of the first end portion configured to be received in the second integrally formed connector and the projection of the second end portion configured to be received in the fourth integrally formed connector.

27. The ice maker as set forth in claim 25, wherein each of the first and third integrally formed connectors comprises a projection that defines a tapered screw hole.

28. The ice maker as set forth in claim 22, wherein the mounting plate is configured to connect to both the water level sensor and the water pump.

29. The ice maker as set forth in claim 28, wherein the mounting plate comprises an integral sensor mount for the water level sensor and an integral pump mount for the water pump.

30. The ice maker as set forth in claim 29, wherein the integral sensor mount and the integral pump mount both comprise bayonet couplings.

31. The ice maker as set forth in claim 22, wherein the water level sensor includes a fitting and the mounting plate comprises a sensor mount for mounting the fitting of the water level sensor on the ice maker at a sensing position in which the fitting connects the water level sensor to the reservoir for detecting the amount of water in the reservoir, the sensor mount being configured to be lockingly engaged with the fitting to releasably mount the fitting on the ice maker at the sensing position.

32. The ice maker as set forth in claim 31, wherein the sensor mount comprises a sensor opening in the mounting plate for receiving the fitting; wherein the fitting comprises a shaft extending along a shaft axis from a proximal end portion to a distal end portion, a bayonet arm extending radially outward from the shaft, and a flange extending radially outward from the shaft at a location proximally spaced from the bayonet arm such that a gap extends along the shaft axis between the bayonet arm and the flange; wherein the sensor opening is configured such that, when the fitting is in a first rotational position about the shaft axis, the fitting is passable into the opening by movement along the shaft axis until the flange engages the mounting plate; wherein when the flange engages the mounting plate, the fitting is rotatable about the shaft axis from the first rotational position in a locking rotational direction to a second rotational position in which a portion of the mounting plate is captured in the gap between the flange and the bayonet arm.

33. The ice maker as set forth in claim 22, wherein the mounting plate comprises a pump mount for mounting the water pump on the ice maker for pumping water from the water reservoir through the passaging; wherein the water pump comprises a pump motor and an intake assembly fixed to the pump motor; wherein the pump mount is configured to mount the water pump such that the intake assembly extends downward from the pump motor into the water reservoir; and wherein the water pump is configured to be connected to the pump mount by a bayonet connection by rotating the pump motor and the intake assembly together as a unit in relation to the pump mount.

* * * * *